US010289057B2

(12) United States Patent
Imanaka et al.

(10) Patent No.: US 10,289,057 B2
(45) Date of Patent: May 14, 2019

(54) IMAGE FORMING APPARATUS THAT CAUSES ONE OF CLEANING MEMBER AND IMAGE BEARING MEMBER INCLUDING PHOTOSENSTIVE LAYER TO RECIPROCATE AND IMAGE FORMING METHOD

(71) Applicant: KYOCERA Document Solutions Inc., Osaka (JP)

(72) Inventors: Yoshitaka Imanaka, Osaka (JP); Hiroaki Watanabe, Osaka (JP); Masahito Ishino, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 47 days.

(21) Appl. No.: 15/515,645

(22) PCT Filed: Oct. 27, 2015

(86) PCT No.: PCT/JP2015/080195
§ 371 (c)(1),
(2) Date: Mar. 30, 2017

(87) PCT Pub. No.: WO2016/068113
PCT Pub. Date: May 6, 2016

(65) Prior Publication Data

US 2017/0300002 A1 Oct. 19, 2017

(30) Foreign Application Priority Data

Oct. 31, 2014 (JP) ..... 2014-222826
Oct. 31, 2014 (JP) ..... 2014-222830

(51) Int. Cl.
*G03G 5/05* (2006.01)
*G03G 21/00* (2006.01)
*G03G 5/147* (2006.01)

(52) U.S. Cl.
CPC ..... *G03G 21/0005* (2013.01); *G03G 5/05* (2013.01); *G03G 5/147* (2013.01); *G03G 5/14704* (2013.01)

(58) Field of Classification Search
CPC ..... G03G 21/0005; G03G 5/14704; G03G 5/147; G03G 5/05
(Continued)

(56) References Cited

U.S. PATENT DOCUMENTS 5,114,814 A * 5/1992 Sakoh ..... G03G 13/01 399/350

FOREIGN PATENT DOCUMENTS

JP 04037874 A * 2/1992
JP 10-143041 A 5/1998
JP 2005242000 A * 9/2005

OTHER PUBLICATIONS

Machine translation of JP 2005-242000 A.*

* cited by examiner

*Primary Examiner* — Susan S Lee
(74) *Attorney, Agent, or Firm* — Studebaker & Brackett PC

(57) ABSTRACT

An image forming apparatus (1) includes a photosensitive drum (50), a cleaning blade (81), and a drive mechanism (90). The cleaning blade (81) is in pressed contact with a circumferential surface of the photosensitive drum (50). The drive mechanism (90) causes one of the photosensitive drum (50) and the cleaning blade (81) to reciprocate in a rotational axis direction (D) of the photosensitive drum (50). The drive mechanism (90) for example causes the photosensitive drum (50) to reciprocate in the rotational axis direction (D). The photosensitive drum (50) includes a photosensitive layer
(Continued)

(85). An outermost layer of the photosensitive layer (85) contains a plurality of particles.

14 Claims, 10 Drawing Sheets

(58) Field of Classification Search
USPC ..... 399/343
See application file for complete search history.

IMAGE FORMING APPARATUS THAT CAUSES ONE OF CLEANING MEMBER AND IMAGE BEARING MEMBER INCLUDING PHOTOSENSTIVE LAYER TO RECIPROCATE AND IMAGE FORMING METHOD

TECHNICAL FIELD

The present invention relates to image forming apparatuses and image forming methods.

BACKGROUND ART

A generic electrophotographic image forming apparatus removes toner adhering to a circumferential surface of a photosensitive drum (image bearing member) using a cleaning blade formed from rubber. As images are formed, at least one of paper dust from transfer sheets (for example, a mass of at least one of cellulose and a filler) and an external additive (for example, titanium oxide) of toner accumulate on and around an edge of the cleaning blade, that is, a portion of the cleaning blade that is in contact with the photosensitive drum. The amount of the accumulation varies from location to location in terms of a rotational axis direction of the photosensitive drum. Accordingly, a location with more accumulation may cause local scraping of the photosensitive drum by the accumulation. Repeated local scraping manifests as a scratch in a circumferential direction on the circumferential surface of the photosensitive drum. As a result, an output image formed on paper has a streak resulting from the scratch in the circumferential direction on the photosensitive drum. In order to form good output images over a long period of time, therefore, it is required to maintain the circumferential surface of the photosensitive drum smooth.

A cleaning blade in an image forming apparatus disclosed in Patent Literature 1 is caused to reciprocate in a rotational axis direction of a photosensitive drum. Accordingly, local accumulation on and around an edge of the cleaning blade can be moved in the rotational axis direction, preventing a local scratch in a circumferential direction from occurring on the circumferential surface of the photosensitive drum.

CITATION LIST

Patent Literature

[Patent Literature 1]
Japanese Patent Application Laid-Open Publication No. H10-143041

SUMMARY OF INVENTION

Technical Problem

However, causing the cleaning blade in the image forming apparatus disclosed in Patent Literature 1 to reciprocate ends up with a reduction in cleaning performance. Consequently, toner remaining on the circumferential surface of the photosensitive drum after image formation (hereinafter, referred to as "residual toner") may firmly adhere to the circumferential surface of the photosensitive drum.

Specifically, the cleaning blade delivers its clearing performance by being pressed against the photosensitive drum. Pressing force of the cleaning blade consists of an initially set pressing force (hereinafter, referred to as static pressing force") and a pressing force generated through the cleaning blade being drawn in a rotation direction of the photosensitive drum (hereinafter, referred to as "dynamic pressing force").

As a result of the cleaning blade being caused to reciprocate in the rotational axis direction of the photosensitive drum, force in the rotational axis direction is applied to an edge of the cleaning blade, reducing the dynamic pressing force. Consequently, the cleaning blade may fail to deliver the clearing performance, leading to insufficient cleaning. As a consequence, toner may constantly escape capture by the cleaning blade over a long period of time to cause residual toner to firmly adhere to the circumferential surface of the photosensitive drum.

In view of the above-described problem, the present invention has been made to provide an image forming apparatus and an image forming method by which adhesion of residual toner to an image bearing member can be restricted while reducing occurrence of a scratch in the circumferential direction on a circumferential surface of an image bearing member.

Solution to Problem

An image forming apparatus according to a first aspect of the present invention includes an image bearing member, a cleaning member, and a drive mechanism. The cleaning member is in pressed contact with a circumferential surface of the image bearing member. The drive mechanism causes one of the image bearing member and the cleaning member to reciprocate in a rotational axis direction of the image bearing member. The image bearing member includes a photosensitive layer. The photosensitive layer has an outermost layer containing a plurality of particles.

An image forming method according to a second aspect of the present invention forms an image on a sheet using a toner. The image forming method includes removing the toner remaining on a circumferential surface of an image bearing member by causing one of the image bearing member and a cleaning member in pressed contact with the circumferential surface of the image bearing member to reciprocate in a rotational axis direction of the image bearing member while causing the image bearing member to rotate. The image bearing member includes a photosensitive layer. The photosensitive layer has an outermost layer containing a plurality of particles. The toner includes a plurality of toner particles. Each of the plurality of toner particles has a toner mother particle and an external additive adhering to a surface of the toner mother particle. The external additive includes an abrasive.

Advantageous Effects of Invention

According to the present invention, it is possible to restrict adhesion of residual toner to the image bearing member while reducing occurrence of a scratch in a circumferential direction on the circumferential surface of the image bearing member.

DESCRIPTION OF EMBODIMENTS

Figure 1:
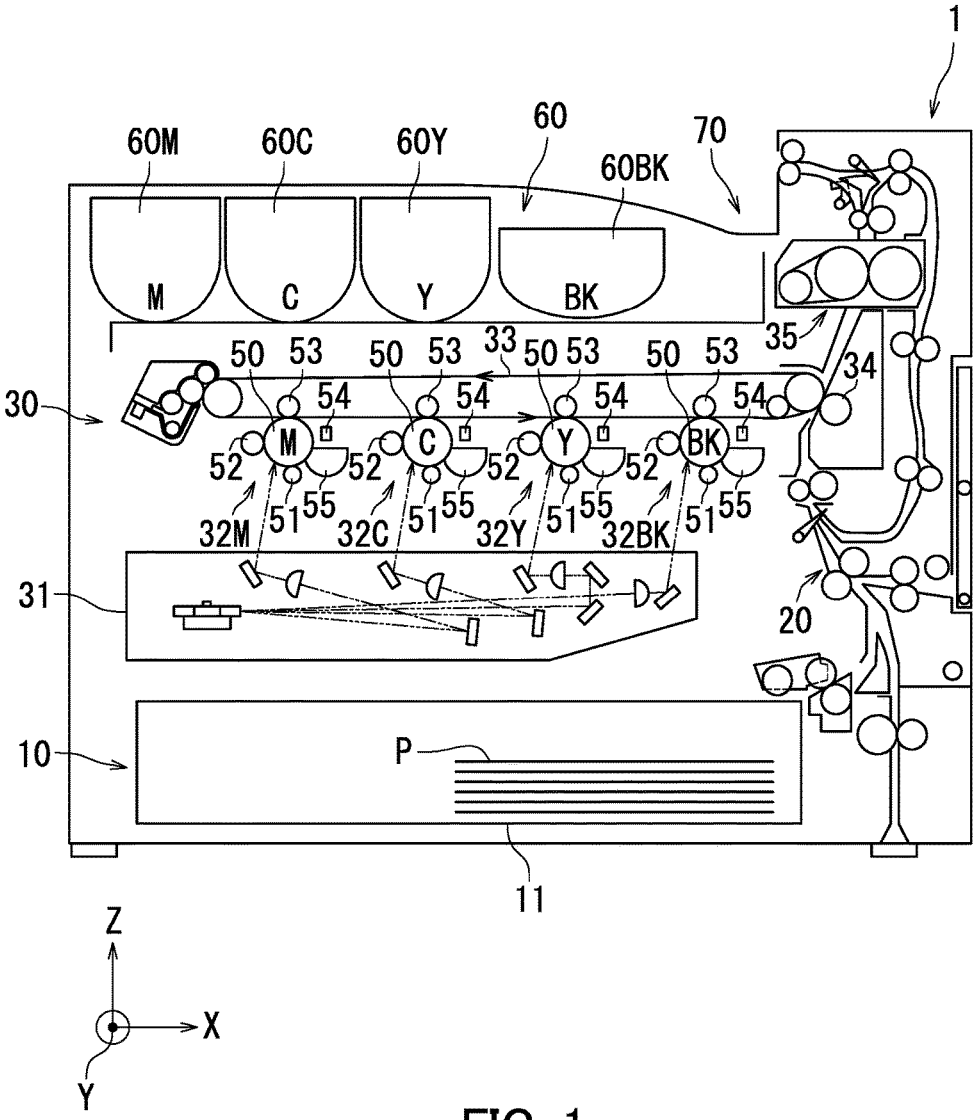
FIG. 1 is a schematic cross-sectional view illustrating an image forming apparatus according to an embodiment of the present invention.

The following describes an embodiment of the present invention with reference to the accompanying drawings. Elements in the drawings that are the same or equivalent are marked by the same reference signs and description thereof is not repeated. In the present embodiment, an X axis, a Y axis, and a Z axis are perpendicular to one another. The X axis and the Y axis are parallel to a horizontal plane, and the Z axis is parallel to a vertical line.

An image forming apparatus 1 according to the embodiment of the present invention will be described with reference to FIG. 1. In the present embodiment, the image forming apparatus 1 is a full-color printer. The image forming apparatus 1 includes a sheet feed section 10, a conveyance section 20, an image forming section 30, a tonner supply section 60, and an ejection section 70. The sheet feed section 10 includes a cassette 11 that accommodates a plurality of sheets P. The sheet feed section 10 feeds each sheet P from the cassette 11 to the conveyance section 20. The sheets P are for example paper sheets or synthetic resin sheets.

The conveyance section 20 conveys each sheet P to the image forming section 30. The image forming section 30 includes a light exposure unit 31, an M unit 32M, a C unit 32C, a Y unit 32Y, a BK unit 32BK, an intermediate transfer belt 33, a secondary transfer roller 34, and a fixing unit 35.

The light exposure unit 31 irradiates each of the M unit 32M to the BK unit 32BK with light based on image data to form an electrostatic latent image for each of the M unit 32M to the BK unit 32BK. The M unit 32M forms a magenta toner image based on the electrostatic latent image. The C unit 32C forms a cyan toner image based on the electrostatic latent image. The Y unit 32Y forms a yellow toner image based on the electrostatic latent image. The BK unit 32BK forms a black toner image based on the electrostatic latent image. The toner images of the four colors are transferred onto an outer surface of the intermediate transfer belt 33 such that the images are superimposed on one another to form a color toner image. The secondary transfer roller 34 transfers, to a sheet P, the color toner image formed on the outer surface of the intermediate transfer belt 33. The fixing unit 35 applies heat and pressure to the sheet P to fix the color toner image to the sheet P. Subsequently, the sheet P is ejected to the ejection section 70.

The M unit 32M, the C unit 32C, the Y unit 32Y, and the BK unit 32BK each include a photosensitive drum 50 (image bearing member), a charging roller 51 (charger), a development roller 52, a primary transfer roller 53, a static elimination lamp 54, and a cleaner 55.

Each of the photosensitive drums 50 rotates about its rotational axis. The photosensitive drums 50 are for example organic photoconductor (OPC) drums. Each of the charging rollers 51 charges a circumferential surface of a corresponding one of the photosensitive drums 50. More specifically, each of the charging rollers 51 is in contact with the circumferential surface of the corresponding photosensitive drum 50 and applies a charging bias to the circumferential surface of the photosensitive drum 50. In the present embodiment, the charging bias is a direct current voltage. However, the charging bias may be a direct current voltage and an alternating current voltage. The light exposure unit 31 forms an electrostatic latent image on the circumferential surface of each of the photosensitive drums 50.

Each of the development rollers 52 causes a toner to adhere to the electrostatic latent image to develop the electrostatic latent image and form a toner image on the circumferential surface of the corresponding photosensitive drum 50. The primary transfer rollers 53 transfer the toner images formed on the circumferential surfaces of the photosensitive drums 50 to the outer surface of the intermediate transfer belt 33 to form a color toner image. Each of the static elimination lamps 54 removes residual charge on the circumferential surface of the corresponding photosensitive drum 50. Each of the cleaners 55 removes toner remaining on the circumferential surface of the corresponding photosensitive drum 50.

The tonner supply section 60 includes a cartridge 60M containing a magenta toner, a cartridge 60C containing a cyan toner, a cartridge 60Y containing a yellow toner, and a cartridge 60BK containing a black toner. The cartridge 60M, the cartridge 60C, the cartridge 60Y, and the cartridge 60BK supply the toners to the development rollers 52 of the M unit 32M, the C unit 32C, the Y unit 32Y, and the BK unit 32BK, respectively.

Figure 2:
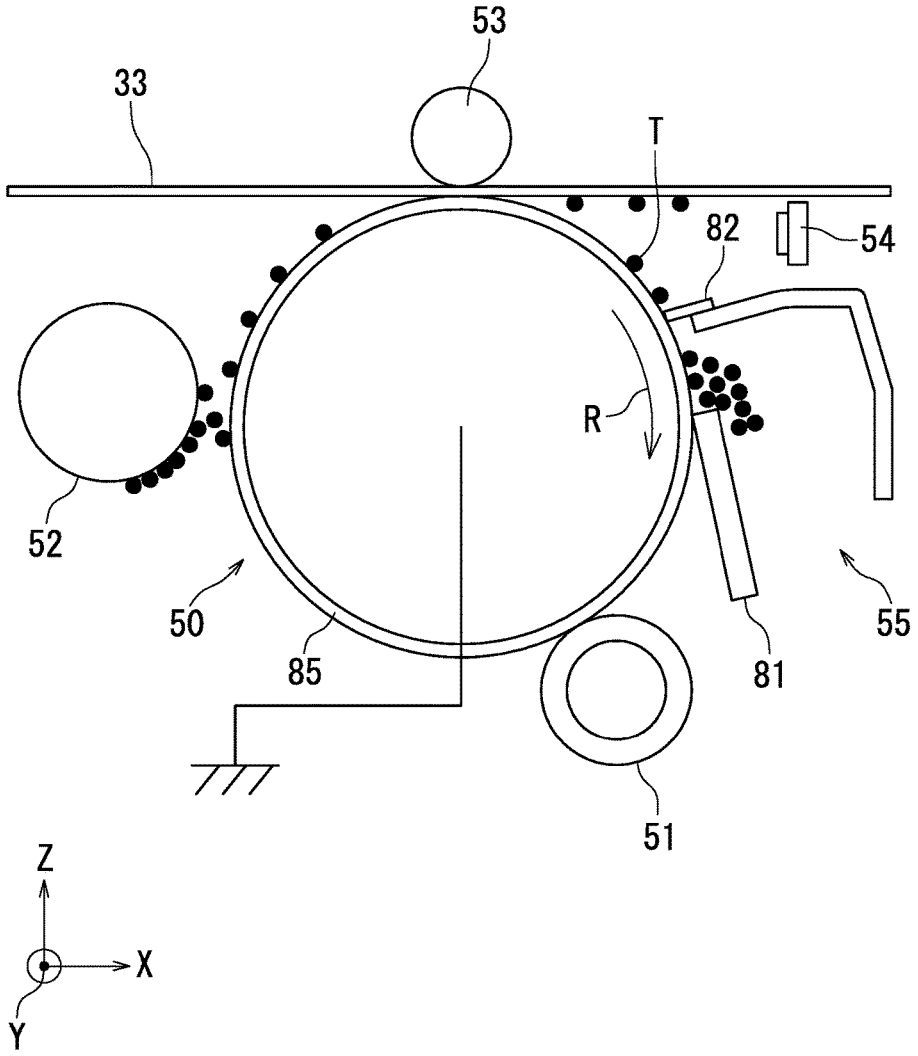
FIG. 2 is a diagram illustrating a cleaner of the image forming apparatus according to the embodiment of the present invention.

The cleaners 55 will be described with reference to FIG. 2. FIG. 2 illustrates one of the cleaners 55. The cleaner 55 includes a cleaning blade 81 (cleaning member) and a toner seal 82.

The cleaning blade 81 is located downstream of the corresponding one of the primary transfer rollers 53 in a rotation direction R of the corresponding photosensitive drum 50 and is in pressed contact with the circumferential surface of the photosensitive drum 50 to remove residual toner T on the circumferential surface of the photosensitive drum 50. More specifically, the edge of the cleaning blade 81 is in pressed contact with the circumferential surface of the photosensitive drum 50. A direction from a proximal end to a distal end of the cleaning blade 81 is opposite to the rotation direction R at a point of contact between the proximal end of the cleaning blade 81 and the circumferential surface of the photosensitive drum 50. The cleaning blade 81 is for example made of rubber.

The toner seal 82 is disposed between the primary transfer roller 53 and the cleaning blade 81, and is in contact with the circumferential surface of the photosensitive drum 50, restricting scattering of the residual toner T removed and collected by the cleaning blade 81.

Figure 3A:
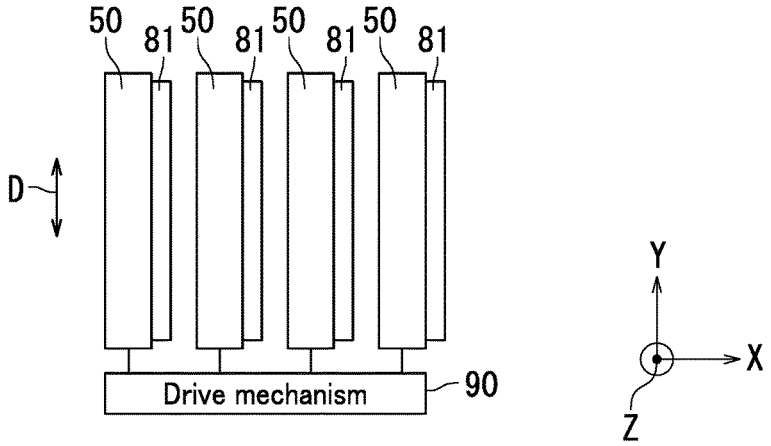
FIG. 3A is a plan view illustrating photosensitive drums, cleaning blades, and a drive mechanism of the image forming apparatus according to the embodiment of the present invention.

The photosensitive drums 50 and the elements thereareound will be described with reference to FIGS. 3A to 3D. FIG. 3A is a plan view illustrating the photosensitive drums 50, the cleaning blades 81, and a drive mechanism 90. Each of the photosensitive drums 50 has a circular tubular shape elongated in a rotational axis direction D of the photosensitive drum 50. Each of the cleaning blades 81 has a plate-like shape elongated in the rotational axis direction D.

The image forming apparatus 1 further includes the drive mechanism 90. The drive mechanism 90 causes either the photosensitive drums 50 or the cleaning blades 81 to reciprocate in the rotational axis direction D. In the present embodiment, the drive mechanism 90 causes the photosensitive drums 50 to reciprocate in the rotational axis direction D. The drive mechanism 90 for example includes a drive source such as a motor, a gear train, a plurality of cams, and a plurality of elastic members. The cleaning blades 81 are fixed to a housing of the image forming apparatus 1.

According to the present embodiment, as illustrated with reference to FIG. 3A, the photosensitive drums 50 are caused to reciprocate in the rotational axis direction D against the cleaning blades 81. Accordingly, local accumulation on and around the edge of each cleaning blade 81 can be moved in the rotational axis direction D, preventing a scratch in the circumferential direction (hereinafter, referred to as "circumferential scratch") from occurring on the circumferential surface of the corresponding photosensitive drum 50. As a result, an output image, that is, an image to be formed on the sheet P can be prevented from having a streak, and thus the quality of output images can be favorably maintained over a long period of time.

Furthermore, according to the present embodiment in which the photosensitive drums 50 are caused to reciprocate, it is easy to obtain driving force required for the reciprocation and restrict occurrence of toner leakage over opposite ends of each of the cleaning blades 81, compared to a configuration in which the cleaning blades 81 are caused to reciprocate.

Figure 3B:
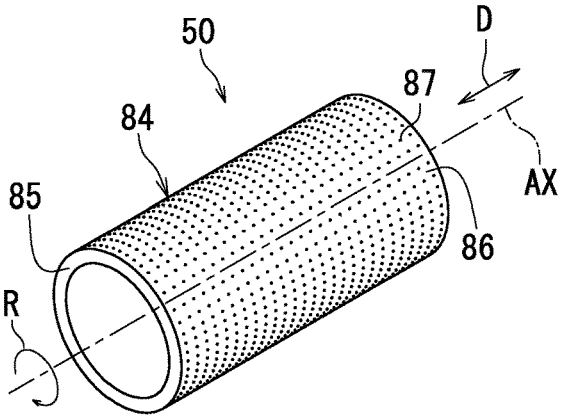
FIG. 3B is a perspective view illustrating a photosensitive drum of the image forming apparatus according to the embodiment of the present invention.

FIG. 3B is a perspective view illustrating one of the photosensitive drums 50. The photosensitive drum 50 rotates about its rotational axis AX in the rotation direction R. The rotational axis direction D is a direction in which the rotational axis AX extends. The photosensitive drum 50 includes a photosensitive layer 85. An outermost layer of the photosensitive layer 85 contains a plurality of particles 87. The photosensitive layer 85 may further contain a charge generating material, a charge transport material, and a binder resin. The photosensitive layer 85 has a circumferential surface 84. The circumferential surface 84 of the photosensitive layer 85 constitutes the circumferential surface of the photosensitive drum 50. The photosensitive layer 85 may include a protective layer. In a configuration in which the photosensitive layer 85 includes the protective layer, preferably, the protective layer also contains the plurality of particles 87. In such a configuration, the protective layer corresponds to the outermost layer of the photosensitive layer 85. Furthermore, the photosensitive layer 85 may be multi-layer (for example, a multi-layer type photosensitive layer) or single-layer (for example, a single-layer type photosensitive layer). In a configuration in which the photosensitive layer 85 is multi-layer, a topmost layer corresponds to the outermost layer. In a configuration in which the photosensitive layer 85 is single-layer, the photosensitive layer 85 as a whole corresponds to the outermost layer.

Since the photosensitive layer 85 contains the plurality of particles 87 according to the present embodiment, as described with reference to FIG. 3B, abrasion of the photosensitive layer 85 can be inhibited.

In addition, since the photosensitive layer 85 contains the plurality of particles 87 according to the present embodiment, friction coefficient of the circumferential surface 84 of the photosensitive layer 85 can be reduced. As a result, adhesion of the residual toner T to the circumferential surface 84 of the photosensitive layer 85 can be restricted. In order to further restrict adhesion of the residual toner T, the circumferential surface 84 of the photosensitive layer 85 preferably has a friction coefficient of no greater than 0.5.

In particular, adhesion of the residual toner T to the circumferential surface 84 of the photosensitive layer 85 can be restricted even if the dynamic pressing force of the pressing force of the cleaning blade 81 is reduced due to the reciprocation of the photosensitive drum 50. That is, reduction of the clearing performance of the cleaning blade 81 due to the reciprocation of the photosensitive drum 50 can be compensated for by reducing the friction coefficient of the circumferential surface 84 of the photosensitive layer 85 through the plurality of particles 87 being contained in the photosensitive layer 85.

Furthermore, the present embodiment can reduce the friction coefficient of the circumferential surface 84 of the photosensitive layer 85 and thus reduce adhesion of the residual toner T while reducing cost and saving space compared to a configuration involving a lubricant and a lubricant application mechanism.

Figure 3C:
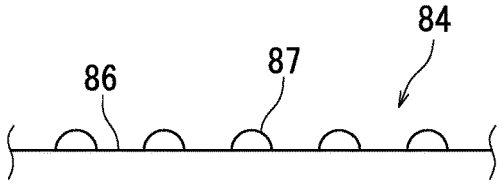
FIG. 3C is an enlarged view of a circumferential surface of a photosensitive drum of the image forming apparatus according to the embodiment of the present invention.

FIG. 3C is an enlarged view of the circumferential surface of one of the photosensitive drums 50. The circumferential surface 84 of the photosensitive layer 85 has a base surface 86. The plurality of particles 87 present on the circumferential surface 84 of the photosensitive layer 85 project from the base surface 86. The plurality of particles 87 projecting from the base surface 86 are uniformly distributed. Accordingly, the circumferential surface 84 of the photosensitive layer 85 is uniformly roughened by the plurality of particles 87. The number of the particles 87 per unit area is for example constant throughout the base surface 86. Each of the particles 87 has a smaller friction coefficient than the base surface 86. That is, each of the particles 87 has a smaller friction coefficient than the binder resin in the photosensitive layer 85. Each of the particles 87 has a greater hardness than the base surface 86. That is, each of the particles 87 has a greater hardness than the binder resin in the photosensitive layer 85. Preferable examples of the particles 87 that have a greater hardness than the binder resin include silicone resin particles and inorganic particles.

According to the present embodiment, as described with reference to FIG. 3C, the plurality of particles 87 project from the base surface 86, and the cleaning blades 81 are in contact with the plurality of particles 87. A contact area between each cleaning blade 81 and the corresponding photosensitive layer 85 is small in such a configuration compared to a configuration in which the circumferential surface of the photosensitive layer is too smooth. Accordingly, the cleaning blade 81 readily slides against the photosensitive layer 85. As a result, the residual toner T can be restricted from escaping capture by the edge of the cleaning blade 81, and thus adhesion of the residual toner T to the photosensitive drum 50 can be further restricted.

Furthermore, according to the present embodiment, the cleaning blade 81 is in contact with the plurality of particles 87, and each of the particles 87 has a smaller friction coefficient than the base surface 86. The cleaning blade 81 slides against the photosensitive layer 85 more readily in such a configuration than a configuration without projecting low-friction-coefficient particles. As a result, the residual toner T can be further restricted from escaping capture by the edge of the cleaning blade 81, and thus adhesion of the residual toner T to the photosensitive drum 50 can be further restricted.

Furthermore, according to the present embodiment, the plurality of particles 87 projecting from the base surface 86 are uniformly distributed. Accordingly, defects in output images that are formed can be reduced, and thus quality of the output images can be increased compared to a configuration in which the plurality of projecting particles are inhomogeneously distributed or locally concentrated.

Furthermore, according to the present embodiment, the particles 87 are harder than the base surface 86. Accordingly, the particles 87 harder than the base surface 86 tend not to be abraded even if the base surface 86 is abraded as the photosensitive layer 85 is abraded. As a result, the plurality of particles 87 readily project from the base surface 86, and thus adhesion of the residual toner T to the photosensitive drum 50 can be restricted. In addition, the hard particles 87 further inhibit abrasion of the photosensitive layer 85.

Figure 3D:
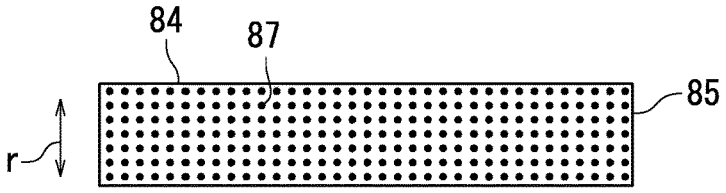
FIG. 3D is a cross-sectional view illustrating a photosensitive layer of a photosensitive drum of the image forming apparatus according to the embodiment of the present invention.

FIG. 3D is a cross-sectional view illustrating one of the photosensitive layers 85 of the photosensitive drums 50. The plurality of particles 87 are uniformly distributed in the photosensitive layer 85. That is, the plurality of particles 87 are uniformly distributed in a radial direction r of the photosensitive layer 50. The number of the particles 87 per unit area is for example constant throughout the photosensitive layer 85.

According to the present embodiment, as described with reference to FIG. 3D, the plurality of particles 87 are uniformly distributed in the photosensitive layer 85. Therefore, the base surface 86 keeps having the plurality of particles 87 present therein or protruding therefrom even if the photosensitive layer 85 is abraded. As a result, adhesion of the residual toner T to the photosensitive drum 50 can be inhibited over a long period of time.

The following describes the toners that are contained in the cartridges 60M to 60B K illustrated in FIG. 1 and that are supplied to the circumferential surfaces of the photosensitive drums 50. Each of the toners is a powder including a plurality of toner particles (a large number of toner particles). The toner particles have toner mother particles and an external additive. The external additive adheres to surfaces of the toner mother particles. The toner mother particles include a binder resin and an internal additive (for example, a releasing agent and a colorant). The external additive may not be contained if unnecessary. In a configuration in which the external additive is not contained, the toner mother particles correspond to the toner particles. Furthermore, the toner mother particles may contain at least one of a charge control agent and a magnetic powder as an internal additive as necessary. The internal additive may not be contained if unnecessary. The toners may be capsule toners. A capsule toner can be produced through formation of a shell layer on a surface of each toner mother particle.

Each of the toners is for example a low-temperature fixable toner that can be fixed at lower temperatures than normal toners and achieve energy saving. The low-temperature fixable toner is for example a toner that includes a binder resin having a softening point (Tm) of no greater than 100° C. and a glass transition point (Tg) of no greater than 55° C. Furthermore, the low-temperature fixable toner is for example a toner having a minimum fixing temperature of no greater than 160° C. when measured in accordance with the following method. More specifically, the low-temperature fixable toner is a toner having a minimum fixing temperature of at least 120° C. and no greater than 150° C. when measured in accordance with the following method.

The method for measuring the minimum fixing temperature will be described. A two-component developer is prepared by mixing 100 parts by mass of a developer carrier (carrier for FS-05250DN) and 5 parts by mass of a sample (toner) for 30 minutes using a ball mill. A color printer (an evaluation apparatus obtained by modifying "FS-C5250DN", product of KYOCERA Document Solutions Inc., to enable adjustment of fixing temperature) having a roller-roller type heat-pressure fixing section is used as an evaluation apparatus. The two-component developer prepared as described above is loaded into a developing section of the evaluation apparatus and the sample (toner) is loaded into a toner container of the evaluation apparatus. An image is formed using the evaluation apparatus to evaluate the low-temperature fixability of the sample (toner).

In the evaluation of the low-temperature fixability of the sample (toner), the evaluation apparatus is used to form a solid image having a size of 25 mm×25 mm on 90 g/m$^2$ paper (A4 size evaluation paper) under a condition of a toner application amount of 1.0 mg/cm$^2$. Subsequently, the paper having the image formed thereon is passed through the fixing section. More specifically, a minimum temperature at which the toner (solid image) is fixable to the paper (minimum fixing temperature) is measured by gradually increasing the fixing temperature of the fixing section.

In measurement of the minimum fixing temperature, whether or not the toner has been fixed is confirmed by a fold-rubbing test such as described below. More specifically, the paper is folded in half such that a surface having the image formed thereon is folded inwards, and a 1 kg weight covered with cloth is rubbed back and forth on the fold five times. Next, the paper is opened up and a fold portion of the paper (a portion having the solid image formed thereon) is observed. Next, the length of toner peeling of the fold portion (peeling length) is measured. The minimum fixing temperature is determined to be the lowest temperature among fixing temperatures for which the peeling length is not greater than 1 mm.

The present low-temperature fixable toner tends to easily adhere to a circumferential surface of a photosensitive drum. In a situation in which the low-temperature fixable toner is used in a generic image forming apparatus, therefore, decrease in the dynamic pressing force of a cleaning blade due to reciprocation makes it more likely that residual toner adheres to the circumferential surface of the photosensitive drum. Many recent generic image forming apparatuses adopt low-temperature fixable toners, and therefore a technique to efficiently restrict adhesion of residual toner has been demanded.

According to the present embodiment, even if the low-temperature fixable toners are used, adhesion of the residual toner T to the photosensitive drums 50 can be restricted by reducing the friction coefficient of the circumferential surfaces of the photosensitive drums 50 while reducing occurrence of a circumferential scratch on the photosensitive drums 50 by causing the photosensitive drums 50 to reciprocate.

Furthermore, in the present embodiment, the external additive of the toners may contain an abrasive. The abrasive is for example a conductive treated inorganic abrasive. Preferably, the abrasive is at least one of an inorganic abrasive including conductive treated titanium oxide and an inorganic abrasive including conductive treated strontium titanate. Surfaces of the photosensitive layers 85 can be effectively refreshed through polishing of the photosensitive layers 85 with the abrasive. In general, an abrasive accumulated on and around an edge of a cleaning blade easily aggregates, and the abrasive enlarged in diameter locally scrapes a photosensitive drum, leading to a high tendency for the photosensitive drum to have a circumferential scratch. However, according to the present embodiment, aggregation of the abrasive can be inhibited by reducing the friction coefficient of the circumferential surfaces of the photosensitive drums 50. As a result, it is possible to effectively refresh the surfaces of the photosensitive layers 85 using the abrasive while further reducing occurrence of a circumferential scratch on the photosensitive drums 50.

The following describes surface roughness of the photosensitive drums 50, thrust amount of the photosensitive drums 50, thrust period of the photosensitive drums 50, content of the particles 87, particle size of the particles 87, hardness of the cleaning blades 81, and rebound resilience of the cleaning blades 81 with reference to FIGS. 3A to 3D.

The surface roughness of the photosensitive drums 50 is roughness of the circumferential surfaces of the photosensitive drums 50, that is, roughness of the circumferential surfaces 84 of the photosensitive layers 85, and refers to a ten-point average roughness Rz in accordance with Japanese Industrial Standard (JIS) in 1982 in the present embodiment. If the photosensitive drums 50 have a too large surface roughness, output images may have a defect such as a streak. In order to reduce occurrence of a defect in output images, the photosensitive drums 50 preferably have a surface roughness of greater than 0 μm and no greater than 2.0 μm.

On the other hand, if the photosensitive drums 50 have a too small surface roughness, the cleaning blades 81 are difficult to slide against the photosensitive drums 50. Consequently, the clearing performance may be reduced, and the residual toner T may adhere to the circumferential surfaces of the photosensitive drums 50. More preferably, the photosensitive drums 50 have a surface roughness of at least 0.2 μm and no greater than 1.5 μm in order to further reduce occurrence of a defect in output images and to further restrict adhesion of the residual toner T.

Figure 4:
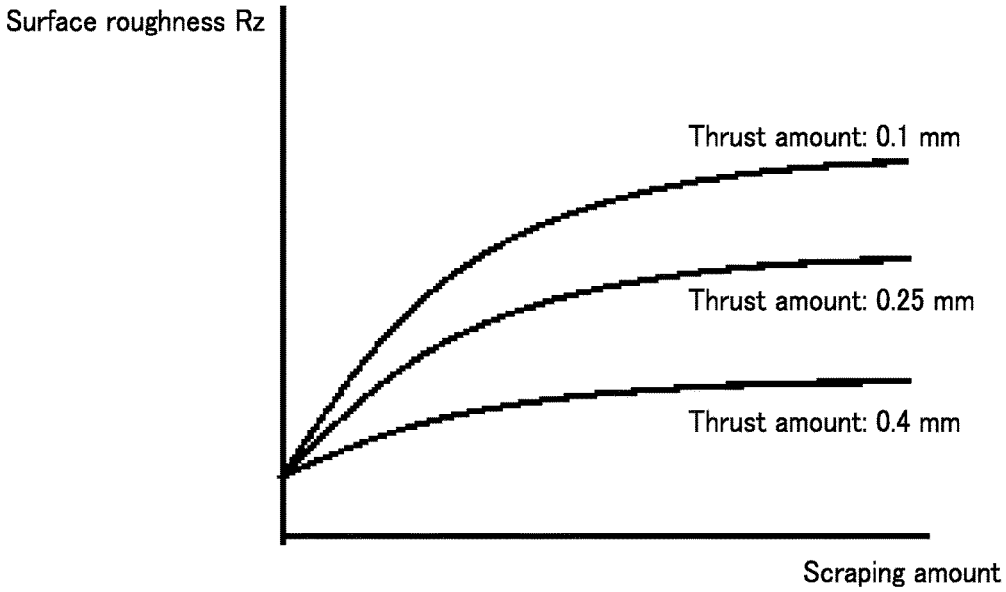
FIG. 4 is a graph showing a relationship between scraping amount and surface roughness of a photosensitive drum with respect to each of specific thrust amounts.

FIG. 4 is a graph showing a relationship between scraping amount and surface roughness of a photosensitive drum 50. The horizontal axis represents scraping amount of the photosensitive drum 50, and the vertical axis represents surface roughness of the photosensitive drum 50. The surface roughness of the photosensitive drum 50 increases as the number of printed pages increases and abrasion of the photosensitive drum 50 progresses (the scraping amount of the photosensitive drum 50 increases). However, the surface roughness of the photosensitive drum 50 can be prevented from being too large by increasing the thrust amount of the photosensitive drum 50.

The thrust amount of the photosensitive drum 50 refers to a distance by which the photosensitive drum 50 travels in one way of one back-and-forth motion. Note that in the present embodiment, an outward thrust amount and a return thrust amount are the same. If the thrust amount of the photosensitive drum 50 is too small, the effect of reducing occurrence of a circumferential scratch on the photosensitive drum 50 may be reduced. On the other hand, if the thrust amount of the photosensitive drum 50 is too large, the residual toner T may adhere to the circumferential surface of the photosensitive drum 50, and the color image forming apparatus 1 may undergo unintended coloristic shift. Preferably, the thrust amount of the photosensitive drum 50 is at least 0.1 mm and no greater than 1.5 mm in order to prevent such events. More preferably, the thrust amount of the photosensitive drum 50 is at least 0.25 mm and no greater than 1.0 mm in order to further prevent such events.

The thrust period of the photosensitive drum 50 refers to a time taken by the photosensitive drum 50 to make one back-and-forth motion. In the present description, the thrust period of the photosensitive drum 50 is indicated by the number of rotations of the photosensitive drum 50 per back-and-forth motion of the photosensitive drum 50. The rotation speed of the photosensitive drum 50 is constant. Accordingly, a longer thrust period of the photosensitive drum 50 means that the photosensitive drum 50 reciprocates more slowly. A shorter thrust period of the photosensitive drum 50 means that the photosensitive drum 50 reciprocates faster.

If the thrust period of the photosensitive drum 50 is too short, the residual toner T may adhere to the circumferential surface of the photosensitive drum 50 and the color image forming apparatus 1 may undergo unintended coloristic shift. On the other hand, if the thrust period of the photosensitive drum 50 is too long, the effect of reducing occurrence of a circumferential scratch on the photosensitive drum 50 may be reduced. Preferably, the thrust period (number of rotations) of the photosensitive drum 50 is at least 10 rotations and no greater than 1,000 rotations in order to prevent such events. More preferably, the thrust period of the photosensitive drum 50 is at least 50 rotations and no greater than 300 rotations in order to further prevent such events.

In the present embodiment, the particles 87 contained in each of the photosensitive layers 85 are a silicone filler. If the content of the particles 87 is too small, the effect of reducing the friction coefficient of the circumferential surface 84 of the photosensitive layer 85 may be reduced. On the other hand, if the content of the particles 87 is too large, the circumferential surface 84 of the photosensitive layer 85 is so rough that insufficient cleaning may occur and electrical characteristics of the photosensitive drum 50 may be reduced. Preferably, the content of the particles 87 is at least 3 parts by mass and no greater than 40 parts by mass relative to 100 parts by mass of the binder resin in the photosensitive layer 85 in order to prevent such events. More preferably, the content of the particles 87 is at least 5 parts by mass and no greater than 30 parts by mass relative to 100 parts by mass of the binder resin in the photosensitive layer 85 in order to further prevent such events. Reduction of electrical characteristics of the photosensitive drum 50 indicates that the photosensitive drum 50 has reduced sensitivity, that is, potential drop cannot be caused by irradiation of the photosensitive drum 50 with light.

In the present embodiment, the particle size of the particles 87 refers to a volume median diameter ($D_{50}$). If the particle size of the particles 87 is too small, the effect of reducing the friction coefficient of the circumferential surface 84 of the photosensitive layer 85 may be reduced. On the other hand, if the particle size of the particles 87 is too large, the circumferential surface 84 of the photosensitive layer 85 is so rough and the contact area between the cleaning blade 81 and the photosensitive layer 85 is so small that insufficient cleaning may occur and electrical characteristics of the photosensitive drum 50 may be reduced. Preferably, the particles 87 have a volume median diameter ($D_{50}$) of at least 0.07 μm and no greater than 5.0 μm in order to prevent such events. More preferably, the particles 87 have a volume median diameter ($D_{50}$) of at least 0.1 μm and no greater than 1.0 μm in order to further prevent such events. The particles 87 for example have a volume median diameter ($D_{50}$) of 0.7 μm. The volume median diameter ($D_{50}$) of the particles 87 can be measured using a particle size distribution analyzer (for example, "Multisizer" produced by Beckman Coulter, Inc. or "FPIA (registered Japanese trademark) 3000" produced by Sysmex Corporation).

In the present embodiment, the hardness of each of the cleaning blade 81 refers to a hardness in accordance with JIS-A. If the hardness of the cleaning blade 81 is too low, the residual toner T may fail to be scraped off. On the other hand, if the hardness of the cleaning blade 81 is too high, the circumferential surface of the photosensitive drum 50 may have a scratch, and squeal (that is, noise of friction between the photosensitive drum 50 and the cleaning blade 81 during rotation of the photosensitive drum 50) may be emitted. In order to prevent such events, the cleaning blade 81 preferably has a hardness of at least 65, and more preferably at least 70 and no greater than 80.

If the rebound resilience of the cleaning blade 81 is too large, the residual toner T may adhere to the photosensitive drum 50. Preferably, the cleaning blade 81 has a rebound resilience of greater than 0% and no greater than 35% in order to further restrict adhesion of the residual toner T. On the other hand, if the rebound resilience of the cleaning blade 81 is too small, insufficient cleaning (residual toner T escaping capture by the cleaning blade) may occur particularly in a low-temperature environment. More preferably, the cleaning blade 81 has a rebound resilience of at least 20% and no greater than 30% in order to further restrict adhesion of the residual toner T and to reduce insufficient cleaning in a low-temperature environment.

According to the present embodiment, as described above with reference to FIGS. 1 to 3D, adhesion of the residual toner T to the photosensitive drums 50 can be restricted by reducing the friction coefficient of the circumferential surfaces of the photosensitive drums 50 while reducing occurrence of a circumferential scratch on the photosensitive drums 50 by causing the photosensitive drums 50 to reciprocate. As a result of reduction of occurrence of a circumferential scratch on the photosensitive drums 50, occurrence of a streak in output images can be reduced. As a result of restriction of adhesion of the residual toner T to the photosensitive drums 50, adhesion of the residual toner T to the sheets P can be restricted.

Furthermore, the present embodiment adopts contact charging by which a charging bias is applied by the charging rollers 51. In general, according to the contact charging, the mechanical strength of the circumferential surface of a photosensitive drum is reduced due to proximal discharge, and therefore a circumferential scratch is more likely to occur and the circumferential scratch on the photosensitive drum is more likely to affect output images than according to corona charging such as with a scorotron. However, according to the present embodiment, it is possible to restrict adhesion of the residual toner T to the photosensitive drums 50 while reducing occurrence of a circumferential scratch on the photosensitive drums 50 even though the contact charging is adopted. Note that application of the present invention is not limited to the contact charging.

Furthermore, in the present embodiment, the charging bias is a direct current voltage and does not include an alternating current voltage. In general, in a configuration in which the charging bias is only an alternating current voltage or in a configuration in which the charging bias is superposed alternating current and direct current voltages, mechanical deterioration of the circumferential surface of a photosensitive drum progresses faster, and a circumferential scratch on the photosensitive drum is more likely to occur. However, according to the present embodiment, the charging bias is only a direct current voltage, and a circumferential scratch on the photosensitive drums is less likely to occur than according to the configuration in which the charging bias is only an alternating current voltage or the configuration in which the charging bias is superposed alternating current and direct current voltages. Furthermore, through the reciprocation of the photosensitive drums 50, it is possible to restrict adhesion of the residual toner T to the photosensitive drums 50 while further reducing occurrence of a circumferential scratch on the photosensitive drums 50. Note that the present invention is also applicable to a configuration in which a direct current voltage and an alternating current voltage are used as the charging bias.

Furthermore, an image forming method that is implemented by the image forming apparatus 1 according to the present embodiment forms an image on a sheet P using toners. The image forming method includes removing the residual toner T on the photosensitive drums 50 by causing either the photosensitive drums 50 or the cleaning blades 81 to reciprocate in the rotational axis direction D of the photosensitive drums 50 while causing the photosensitive drums 50 to rotate (toner removal step). In the present embodiment, the photosensitive drums 50 are caused to reciprocate in the rotational axis direction D of the photosensitive drums 50. The photosensitive drums 50 each include the photosensitive layer 85 containing the plurality of particles 87. According to the image forming method of the present embodiment, it is possible to restrict adhesion of the residual toner T to the photosensitive drums 50 while reducing occurrence of a circumferential scratch on the photosensitive drums 50.

The following describes the present invention in detail based on Examples. However, the present invention is not limited to the following Examples.

A multifunction peripheral was used as the image forming apparatus 1 in Examples, Reference Examples, and Comparative Examples of the present invention. In Examples, a silicone filler (volume median diameter ($D_{50}$): 0.7 μm) was contained as the particles 87 in the photosensitive layers 85. In Reference Examples and Comparative Examples (except Comparative Examples 4 and 5), no silicone filler as the particles 87 was contained in the photosensitive layers. The term content and the term additive amount used in Examples, Reference Examples, and Comparative Examples have the same meaning.

The multifunction peripheral was a modified TASKalfa2550Ci (product of KYOCERA Document Solutions Inc.). The multifunction peripheral conveyed paper as the sheets P to the image forming section 30 such that longer edges of the paper are perpendicular to a paper conveyance direction. That is, the multifunction peripheral performed lateral sheet conveyance.

Conditions of the multifunction peripheral for the experiments were as shown below.

Photosensitive drum 50: positively chargeable single-layer OPC drum
Rotation speed of photosensitive drum 50: 160 mm/second
Diameter of photosensitive drum 50: 30 mm
Thickness of photosensitive layer 85 in photosensitive drum 50: 30 μm
Material of charging roller 51: epichrolohydrin rubber
Diameter of charging roller 51: 12 mm
Charging bias: direct current voltage
Development: touchdown development
Development bias: alternating current voltage and direct current voltage
Development roller 52: non-contact with photosensitive drum 50
Material of cleaning blades 81: urethane rubber
Thickness of cleaning blade 81: 2.0 mm
Hardness of cleaning blade 81: 79 in accordance with JIS-A unless otherwise stated Rebound resilience of cleaning blade 81: 30% unless otherwise stated The touchdown development herein involves: causing a two-component developer containing a toner and a carrier to be borne on a circumferential surface of a magnetic roller; transferring only the toner from the two-component developer borne on the circumferential surface of the magnetic roller to a circumferential surface of the development roller 52 to form a toner layer on the circumferential surface of the development roller 52; and transferring the toner from the toner layer to an electrostatic latent image formed on the circumferential surface of the photosensitive drum 50 to develop the electrostatic latent image into a toner image.

Measurement devices that were used in Examples and Reference Examples, and measurements therein will be described.

The hardness of the cleaning blades 81 was in accordance with JIS-A. The measurement device used for the hardness of the cleaning blades 81 was an ASKER Rubber Hardness Tester Type A produced by KOBUNSHI KEIKI CO., LTD (in accordance to with JIS K 6253).

The surface roughness of the photosensitive drums 50 was ten-point average roughness Rz in accordance with JIS in 1982. The measurement device used for the surface roughness was SURFCOM 1500DX produced by TOKYO SEIMITSU CO., LTD.

Hereinafter, Reference Examples will be first described, and then Examples will be described in comparison with Comparative Examples in order to facilitate understanding.

REFERENCE EXAMPLE 1

In Reference Example 1, lateral sheet conveyance of A4 size paper was performed, and printing was performed on 100,000 successive sheets of the paper (i.e., 100,000-sheet continued printing was performed) using an original document including characters at a coverage of 5% in a standard temperature and humidity environment (from 23° C. to 26° C. and from 40% RH to 60% RH) to study a relationship between the thrust amount of a photosensitive drum and occurrence of a circumferential scratch on the photosensitive drum. A circumferential scratch on the photosensitive drum was measured as the surface roughness of the photosensitive drum. Furthermore, printing of a halftone image was performed after the 100,000-sheet continued printing to observe presence of a streak in a resulting image.

Figure 5:
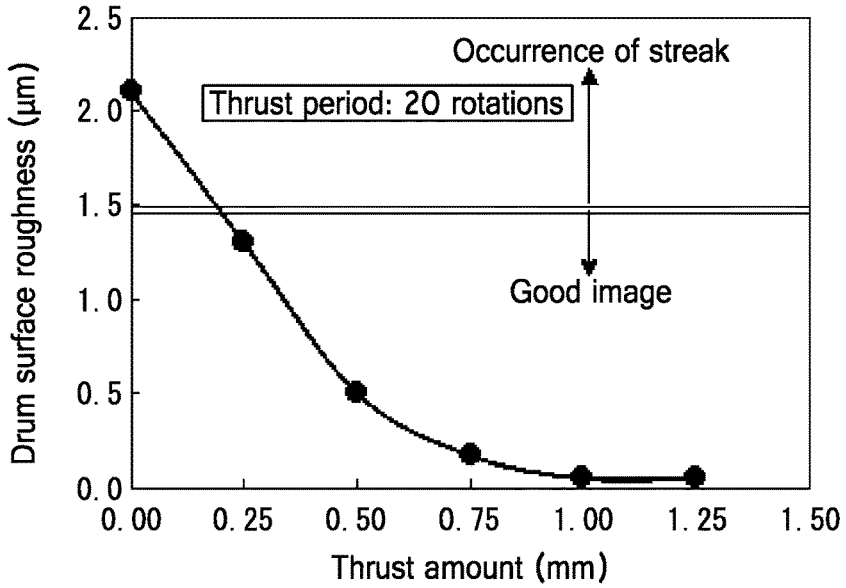
FIG. 5 is a graph showing a relationship between thrust amount and surface roughness of a photosensitive drum of an image forming apparatus according to Reference Example 1.

FIG. 5 is a graph showing a relationship between the thrust amount of the photosensitive drum and the surface roughness of the photosensitive drum after the 100,000-sheet continued printing shown in Table 1. The horizontal axis represents thrust amount (mm) of the photosensitive drum, and the vertical axis represents surface roughness (μm) of the photosensitive drum indicating circumferential scratch depth. The thrust amount of the photosensitive drum was varied with the thrust period of the photosensitive drum fixed at 20 rotations. The 100,000-sheet continued printing was performed, and subsequently the surface roughness of the photosensitive drum was measured.

TABLE 1

| Thrust amount (mm) | Surface roughness (μm) |
|---|---|
| 0.00 | 2.10 |
| 0.25 | 1.30 |
| 0.50 | 0.50 |
| 0.75 | 0.17 |
| 1.00 | 0.05 |
| 1.25 | 0.05 |

In the image streak observation, a streak was observed in the resulting halftone image once the surface roughness of the photosensitive drum exceeded 1.5 μm. It was confirmed that the surface roughness of the photosensitive drum decreased, and occurrence of a circumferential scratch on the photosensitive drum decreased with increase in the thrust amount of the photosensitive drum. The halftone image printed was good when the thrust amount of the photosensitive drum was not less than 0.2 mm. The reason for the above is that the effects of reducing aggregation or accumulation of paper dust and the external additive on and around the edge of the cleaning blade increased with increase in the thrust amount of the photosensitive drum.

REFERENCE EXAMPLE 2

In Reference Example 2, a relationship between the thrust period of a photosensitive drum and occurrence of a circumferential scratch on the photosensitive drum was studied using the multifunction peripheral in the same manner as in Reference Example 1. A circumferential scratch on the photosensitive drum was measured as the surface roughness of the photosensitive drum.

Figure 6:
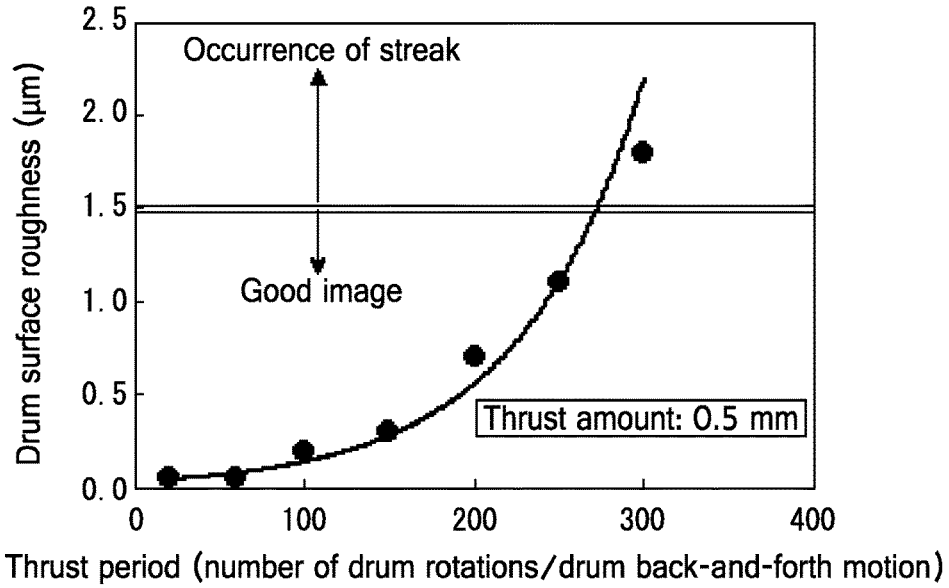
FIG. 6 is a graph showing a relationship between thrust period and surface roughness of a photosensitive drum of an image forming apparatus according to Reference Example 2.

FIG. 6 is a graph showing a relationship between the thrust period of the photosensitive drum and the surface roughness of the photosensitive drum after the above-described 100,000-sheet continued printing shown in Table 2. The horizontal axis represents thrust period of the photosensitive drum (number of photosensitive drum rotations/photosensitive drum back-and-forth motion), and the vertical axis represents surface roughness (μm) of the photosensitive drum indicating circumferential scratch depth. The thrust period of the photosensitive drum was varied with the thrust amount of the photosensitive drum fixed at 0.5 mm. The 100,000-sheet continued printing was performed with respect to each thrust period, and subsequently the surface roughness of the photosensitive drum was measured.

TABLE 2

| Thrust period (number of rotations) | Surface roughness (μm) |
|---|---|
| 20 | 0.05 |
| 60 | 0.05 |
| 100 | 0.20 |
| 150 | 0.30 |
| 200 | 0.70 |
| 250 | 1.10 |
| 300 | 1.80 |

A streak was observed in the resulting halftone image once the surface roughness of the photosensitive drum exceeded 1.5 μm. It was confirmed that the surface roughness of the photosensitive drum decreased, and occurrence of a circumferential scratch on the photosensitive drum decreased with decrease in the thrust period of the photosensitive drum. The halftone image printed was good when the thrust period of the photosensitive drum was not greater than 270. Presumably, the reason for the above is that the effects of preventing aggregation or accumulation of paper dust and the external additive on and around the edge of the cleaning blade increased with decrease in the thrust period of the photosensitive drum.

According to Reference Example 1 and Reference Example 2, occurrence of a circumferential scratch on the photosensitive drum decreased with increase in the thrust amount of the photosensitive drum, and occurrence of a circumferential scratch on the photosensitive drum decreased with decrease in the thrust period of the photosensitive drum. That is, occurrence of a circumferential scratch on the photosensitive drum decreased with increase in thrust rate (=thrust amount/thrust period) of the photosensitive drum.

EXAMPLE 1

In Example 1, a photosensitive drum 50 was used whose circumferential surface had been adjusted to have a friction coefficient of 0.35 by adding 5 parts by mass of a silicone filler as the particles 87 relative to 100 parts by mass of a binder resin in the photosensitive layer 85 based on a relationship shown in FIG. 9 to be described later. A relationship between adhesion of toner to the photosensitive drum 50 and the thrust period and the thrust amount of the photosensitive drum 50 was studied.

Formulation of the photosensitive layer 85 was as described below. That is, a single-layer photosensitive member including the photosensitive layer 85 formed from 100 parts by mass of a binder resin, 5 parts by mass of a charge generating material, 50 parts by mass of a hole transport material, 35 parts by mass of an electron transport material, and 5 parts by mass of the above-mentioned silicone filler ("X-52-854", product of Shin-Etsu Chemical Co., Ltd., a silicone resin, volume median diameter ($D_{50}$): 0.7 (μm)) was used.

A resin having a repeating unit represented by formula (Resin-7) shown below was used as the binder resin.

[Formula 1]

(Resin-7)

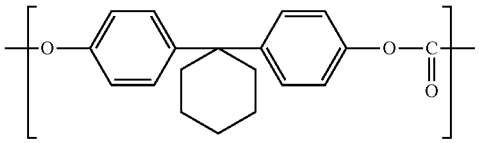

X-form metal-free phthalocyanine represented by formula (CG-1) shown below was used as the charge generating material.

[Formula 2]

(CG-1)

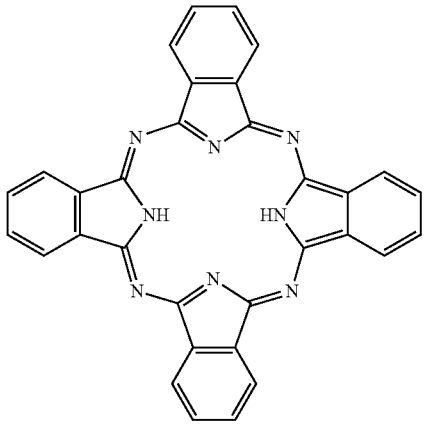

A compound represented by formula (HT-1) shown below was used as the hole transport material.

[Formula 3]

(HT-1)

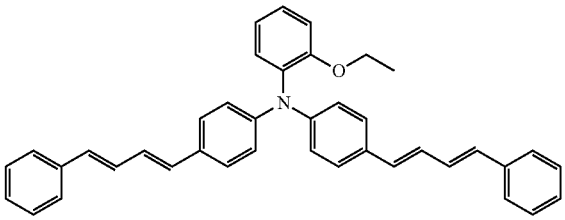

A compound represented by formula (ET-1) shown below was used as the electron transport material.

[Formula 4]

(ET-1)

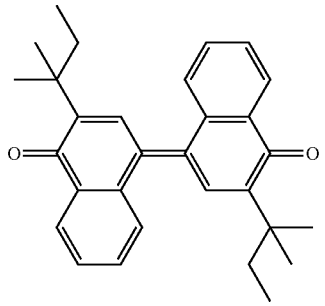

Adhesion of toner to the photosensitive drum 50 is more likely to occur when the internal temperature of the apparatus is high. Therefore, lateral sheet conveyance of A4 size paper was performed, and printing was performed on 50,000 successive sheets of the paper (i.e., 50,000-sheet continued printing was performed) using an original document including characters at a coverage of 5% in a high temperature and humidity environment (32.5° C. and 80% RH). After the 50,000-sheet continued printing, dots of adhering toner included in an entire circumferential surface of the photosensitive drum were counted.

Figure 7:
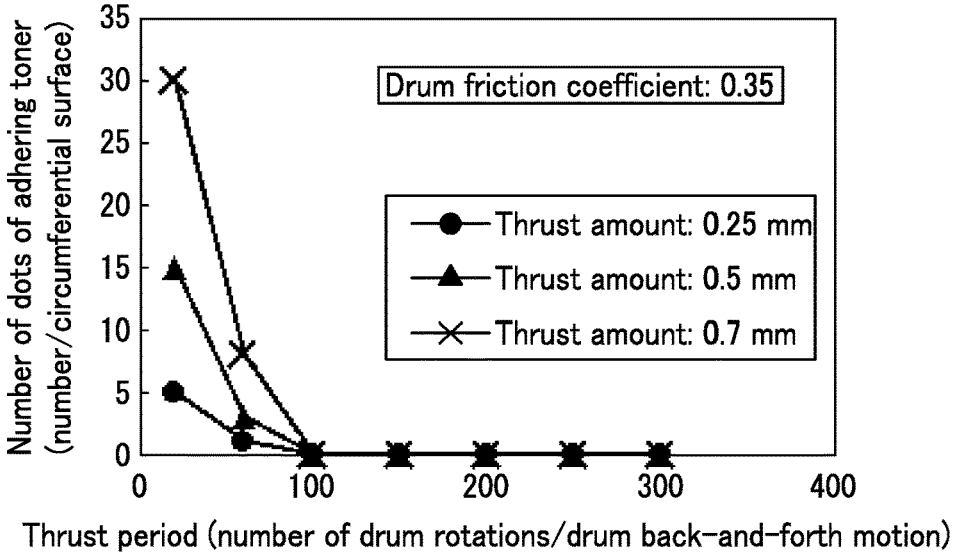
FIG. 7 is a graph showing a relationship between thrust period of a photosensitive drum of an image forming apparatus according to Example 1 of the present invention and the number of dots of adhering toner included in an entire circumferential surface of the photosensitive drum.

FIG. 7 is a graph showing a relationship between the thrust period of the photosensitive drum 50 shown in Table 3 and the number of dots of adhering toner included in the entire circumferential surface of the photosensitive drum 50. The horizontal axis represents thrust period (number of rotations of photosensitive drum per back-and-forth motion of photosensitive drum) of the photosensitive drum 50, and the vertical axis represents the number of dots of adhering toner. The thrust period of the photosensitive drum 50 was varied for each of three values of the thrust amount of the photosensitive drum 50 (0.25 mm, 0.5 mm, and 0.7 mm) to carry out the experiment. The second column, the third column, and the forth column of Table 3 respectively show the number of dots of adhering toner when the thrust amount of the photosensitive drum 50 was 0.25 mm, 0.5 mm, and 0.7 mm.

TABLE 3

| Thrust period (number of rotations) | Thrust amount 0.25 mm | Thrust amount 0.5 mm | Thrust amount 0.7 mm |
|---|---|---|---|
| 20 | 5 | 15 | 30 |
| 60 | 1 | 3 | 8 |
| 100 | 0 | 0 | 0 |
| 150 | 0 | 0 | 0 |
| 200 | 0 | 0 | 0 |
| 250 | 0 | 0 | 0 |
| 300 | 0 | 0 | 0 |

The number of dots of adhering toner decreased with increase in the thrust period of the photosensitive drum 50, and the number of dots of adhering toner decreased with decrease in the thrust amount of the photosensitive drum 50. That is, the amount of toner adhering to the photosensitive drum 50 decreased with decrease in the thrust rate (=thrust amount/thrust period) of the photosensitive drum 50. Furthermore, when the thrust period of the photosensitive drum 50 was not less than 100 rotations, the number of dots of adhering toner was 0, that is, no toner was adhering to the photosensitive drum 50 regardless of the thrust amount.

COMPARATIVE EXAMPLE 1

Figure 9:
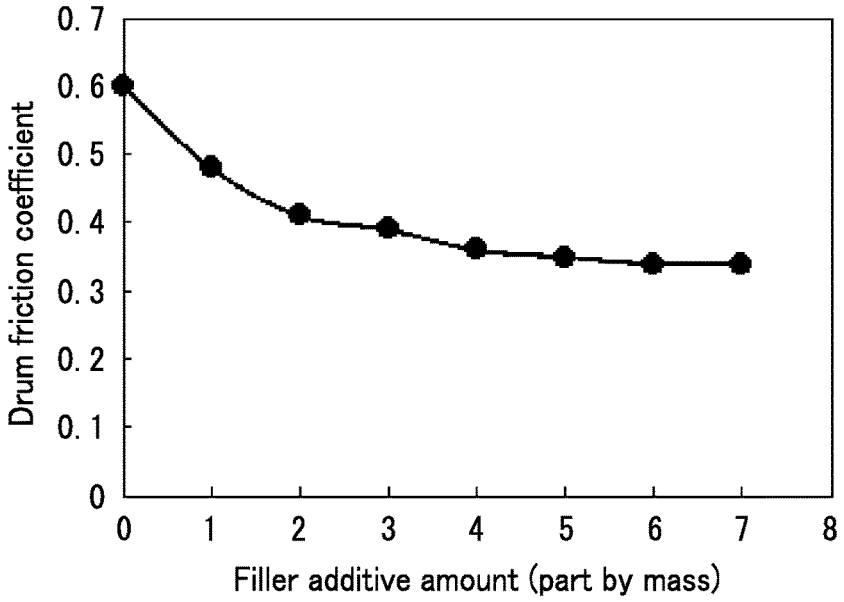
FIG. 9 is a graph showing a relationship between additive amount of a silicone filler and friction coefficient of circumferential surfaces of resulting photosensitive drums of an image forming apparatus according to Example 3 of the present invention.

In Comparative Example 1, a relationship between adhesion of toner to a photosensitive drum and the thrust period and the thrust amount of the photosensitive drum was studied using the multifunction peripheral in the same manner as in Example 1 except that no silicone filler as the particles 87 was contained in the photosensitive layer, and the friction coefficient of the circumferential surface of the photosensitive drum was 0.6 as shown in FIG. 9 to be described later.

Figure 8:
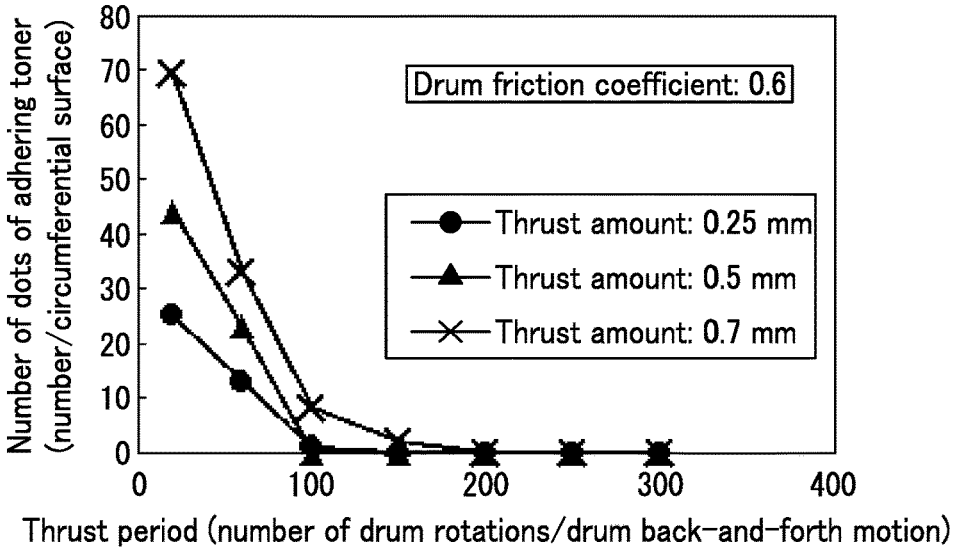
FIG. 8 is a graph showing a relationship between thrust period of a photosensitive drum of an image forming apparatus according to Comparative Example 1 and the number of dots of adhering toner included in an entire circumferential surface of the photosensitive drum.

FIG. 8 is a graph showing a relationship between the thrust period of the photosensitive drum and the number of dots of adhering toner included in an entire circumferential surface of the photosensitive drum shown in Table 4. The horizontal axis represents thrust period of the photosensitive drum, and the vertical axis represents the number of dots of adhering toner. The thrust period of the photosensitive drum was varied for each of three values of the thrust amount of the photosensitive drum (0.25 mm, 0.5 mm, and 0.7 mm), and dots of adhering toner included in the entire circumferential surface of the photosensitive drum were counted. The second column, the third column, and the forth column of Table 4 respectively show the number of dots of adhering toner when the thrust amount of the photosensitive drum was 0.25 mm, 0.5 mm, and 0.7 mm.

TABLE 4

| Thrust period (number of rotations) | Thrust amount 0.25 mm | Thrust amount 0.5 mm | Thrust amount 0.7 mm |
|---|---|---|---|
| 20 | 25 | 44 | 69 |
| 60 | 13 | 23 | 33 |
| 100 | 1 | 0 | 8 |
| 150 | 0 | 0 | 2 |
| 200 | 0 | 0 | 0 |
| 250 | 0 | 0 | 0 |
| 300 | 0 | 0 | 0 |

The number of dots of adhering toner decreased with increase in the thrust period of the photosensitive drum, and the number of dots of adhering toner decreased with decrease in the thrust amount of the photosensitive drum. That is, the amount of toner adhering to the photosensitive drum decreased with decrease in the thrust rate of the photosensitive drum.

Comparison between Example 1 and Comparative Example 1 has confirmed that the amount of toner adhering to the photosensitive drum 50 decreases with decrease in the friction coefficient of the circumferential surface of the photosensitive drum 50.

EXAMPLE 2

In Example 2, a photosensitive drum 50 was used whose circumferential surface had been adjusted to have a friction coefficient of 0.36 by adding 4 parts by mass of the silicone filler as the particles 87 relative to 100 parts by mass of the binder resin in the photosensitive layer 85 based on the relationship shown in FIG. 9 to be described later. The thrust amount and the thrust period of the photosensitive drum 50 were varied under conditions of a hardness of the cleaning blade 81 of 79 and a rebound resilience of the cleaning blade 81 of 26%. Continued printing was performed with respect to each thrust amount and each thrust period. Subsequently, presence of a streak in a halftone image printed on paper (image streak) and adhesion of toner to the photosensitive drum 50 were observed.

Conditions for the image streak observation were as follows. After printing of an image was performed on 100,000 successive sheets of paper (i.e., after 100,000-sheet continued printing) using an original document including characters at a coverage of 5% in a standard temperature and humidity environment (from 23° C. to 26° C. and from 40% RH to 60% RH), the halftone image was printed, and presence of an image streak was visually observed. Results of the image streak observation were evaluated as A1 or B1. Evaluation A1 indicates that no streak was found in the resulting halftone image, and the resulting halftone image was good. Evaluation B1 indicates that a streak was found in the resulting halftone image. Note that evaluation B1 may be tolerable depending on specifications of the image forming apparatus 1.

Conditions for the toner adhesion observation were as follows. Lateral sheet conveyance of A4 size paper was performed, and printing was performed on 50,000 successive sheets of the paper (i.e., 50,000-sheet continued printing was performed) using an original document including characters at a coverage of 5% in a high temperature and humidity environment (32.5° C. and 80% RH). After the 50,000-sheet continued printing, dots of adhering toner included in an entire circumferential surface of the photosensitive drum 50 were counted. Results of the toner adhesion observation were evaluated as A2 or B2. Evaluation A2 indicates that the number of dots of adhering toner was 0, and no toner was adhering to the photosensitive drum 50. Evaluation B2 indicates that the number of dots of adhering toner was at least 1, and toner was adhering to the photosensitive drum 50. Note that evaluation B2 may be tolerable depending on specifications of the image forming apparatus 1.

Table 5 shows evaluation results. The result of the image streak observation was evaluated as A1, and the result of the toner adhesion observation was evaluated as A2, achieving both reduction of occurrence of a streak in the halftone image and restriction of adhesion of toner to the photosensitive drum 50 when "the thrust amount was 0.3 mm and the thrust period was 100 rotations", when "the thrust amount was 0.3 mm and the thrust period was 250 rotations", when "the thrust amount was 0.5 mm and the thrust period was 100 rotations", and when "the thrust amount was 0.5 mm and the thrust period was 250 rotations".

TABLE 5

| Thrust amount (mm) | Thrust period (number of rotations) | Image streak observation | Toner adhesion observation |
|---|---|---|---|
| 0 | — | B1 | A2 |
| 0.1 | 20 | B1 | B2 |
| | 100 | B1 | A2 |
| | 250 | B1 | A2 |
| | 300 | B1 | A2 |
| 0.3 | 20 | A1 | B2 |
| | 100 | A1 | A2 |
| | 250 | A1 | A2 |
| | 300 | B1 | A2 |
| 0.5 | 20 | A1 | B2 |
| | 100 | A1 | A2 |
| | 250 | A1 | A2 |
| | 300 | B1 | A2 |

Filler additive amount: 4 parts by mass
Blade hardness: 79
Blade rebound resilience: 26%

COMPARATIVE EXAMPLE 2

In Comparative Example 2, the thrust amount and the thrust period of a photosensitive drum were varied, and occurrence of a streak (image streak) in a halftone image printed on paper and adhesion of toner to the photosensitive drum were observed with respect to each thrust amount and each thrust period using the multifunction peripheral in the same manner as in Example 2 except that the additive amount of the silicone filler as the particles 87 was 0 parts by mass, and the friction coefficient of the circumferential surface of the photosensitive drum was 0.6 as shown in FIG. 9 to be described later. Conditions for the image streak observation were the same as in Example 2. Conditions for the toner adhesion observation were the same as in Example 2.

Table 6 shows evaluation results. In Comparative Example 2, there was no case in which the result of the image streak observation was evaluated as A1 and the result of the toner adhesion observation was evaluated as A2. That is, Comparative Example 2 could not achieve both reduction of occurrence of a streak in the halftone image and restriction of adhesion of toner to the photosensitive drum after the continued printing.

TABLE 6

| Thrust amount (mm) | Thrust period (number of rotations) | Image streak observation | Toner adhesion observation |
|---|---|---|---|
| 0 | — | B1 | A2 |
| 0.1 | 20 | B1 | B2 |
| | 100 | B1 | B2 |
| | 250 | B1 | A2 |
| | 300 | B1 | A2 |
| 0.3 | 20 | A1 | B2 |
| | 100 | A1 | B2 |
| | 250 | A1 | B2 |
| | 300 | B1 | A2 |
| 0.5 | 20 | A1 | B2 |
| | 100 | A1 | B2 |
| | 250 | A1 | B2 |
| | 300 | B1 | A2 |

Filler additive amount: 0 parts by mass
Blade hardness: 79
Blade rebound resilience: 26%

EXAMPLE 3

In Example 3, a relationship between the additive amount of the silicone filler as the particles 87 and the friction coefficient of the circumferential surfaces of resulting photosensitive drums 50 was studied.

FIG. 9 is a graph showing the relationship between the additive amount of the silicone filler and the friction coefficient of the circumferential surfaces of the photosensitive drums 50 shown in Table 7. The horizontal axis represents additive amount (parts by mass) of the silicone filler relative to 100 parts by mass of the binder resin in the photosensitive layer 85, and the vertical axis represents friction coefficient of the circumferential surfaces of the photosensitive drums 50.

TABLE 7

| Filler additive amount (parts by mass) | Drum friction coefficient |
|---|---|
| 0 | 0.60 |
| 1 | 0.48 |
| 2 | 0.41 |
| 3 | 0.39 |
| 4 | 0.36 |
| 5 | 0.35 |

TABLE 7-continued

| Filler additive amount (parts by mass) | Drum friction coefficient |
|---|---|
| 6 | 0.34 |
| 7 | 0.34 |

Through addition of the silicone filler, the friction coefficient of the circumferential surface of the photosensitive drum 50 could be reduced. However, the friction coefficient of the circumferential surfaces of the photosensitive drums 50 was confirmed to hardly change with an additive amount of the silicone filler of not less than 4 parts by mass.

EXAMPLE 4

In Example 4, the additive amount of the silicone filler as the particles 87 was varied, and cleanability of each resulting photosensitive drum 50 was studied at a thrust rate of 100.00 (μm/drum rotation). The additive amount of the silicone filler was an additive amount (part by mass) relative to 100 parts by mass of the binder resin in the photosensitive layer 85. The cleanability was evaluated according to whether or not cleaning could be performed without the toner or the external additive on the photosensitive drum 50 escaping capture by the cleaning blade 81.

Figure 10A:
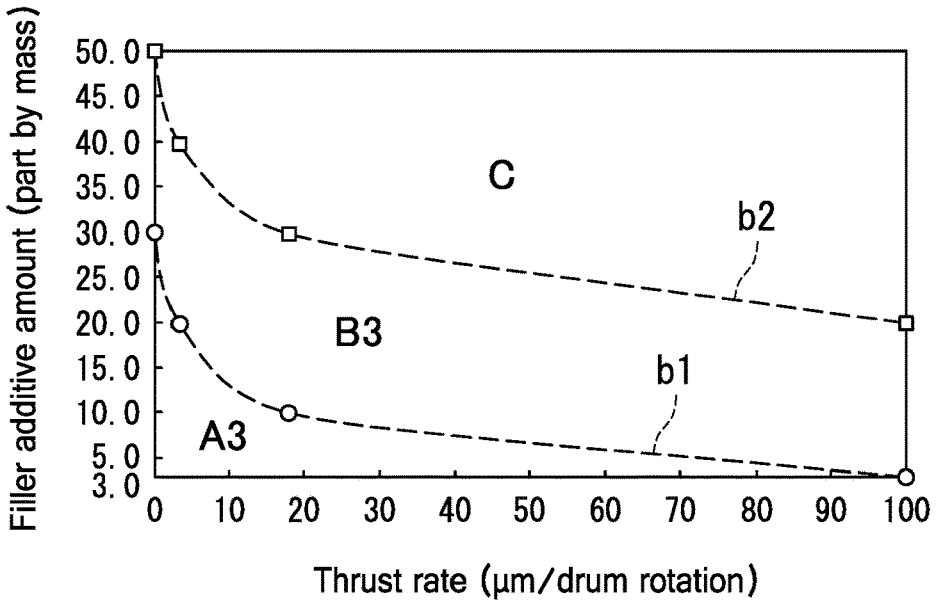
FIG. 10A is a diagram showing a relationship between thrust rate, additive amount of a silicone filler, and cleanability of image forming apparatuses according to Examples 4 to 6 of the present invention.
Figure 10B:
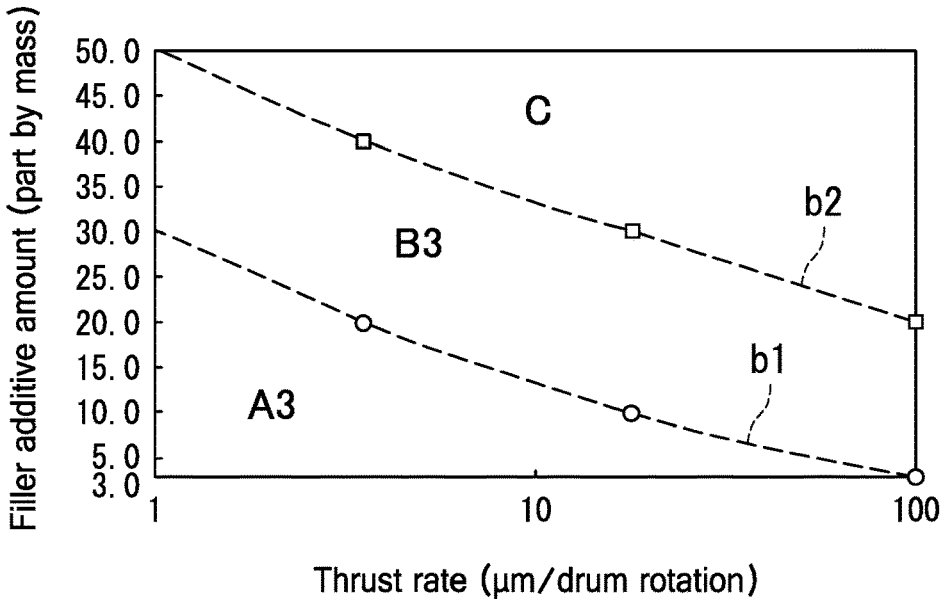
FIG. 10B is a diagram showing a relationship between thrust rate, additive amount of a silicone filler, and cleanability of image forming apparatuses according to Examples 4 to 6 of the present invention.

For the cleanability, lateral sheet conveyance of A4 size paper was performed, and printing was performed on 100,000 successive sheets of the paper (i.e., 100,000-sheet continued printing was performed) using an original document including characters at a coverage of 5% in a low temperature and humidity environment (10° C. and 10% RH) to confirm presence of toner or external additive having escaped capture by the cleaning blade 81 through visual observation of staining on the surface of the photosensitive drum 50 and the paper. As shown in FIGS. 10A and 10B to be described later, a region resulting in no toner or external additive escaping capture by the cleaning blade and sufficient cleaning was evaluated as A3. A region resulting in no toner and some external additive escaping capture by the cleaning blade, and the surface of the photosensitive drum 50 appearing white was evaluated as B3. A region resulting in some toner escaping capture by the cleaning blade, and the surface of the photosensitive drum 50 and the paper having staining was evaluated as C. Table 8 shows evaluation results.

TABLE 8

| Thrust amount (μm) | Thrust period (number of rotations) | Thrust rate (μm/drum rotation) |
|---|---|---|
| 100 | 1 | 100.00 |
| Filler additive amount | | Cleanability |
| 3 | | A3 |
| 10 | | B3 |
| 20 | | B3 |
| 30 | | C |
| 40 | | C |
| 50 | | C |

EXAMPLE 5

In Example 5, the additive amount of the silicone filler as the particles 87 was varied, and cleanability of each resulting photosensitive drum 50 was studied at a thrust rate of 17.86 (μm/drum rotation). The cleanability was evaluated in the same manner as in Example 4. Table 9 shows evaluation results.

TABLE 9

| Thrust amount (μm) | Thrust period (number of rotations) | Thrust rate (μm/drum rotation) |
|---|---|---|
| 250 | 14 | 17.86 |
| Filler additive amount | | Cleanability |
| 3 | | A3 |
| 10 | | A3 |
| 20 | | B3 |
| 30 | | B3 |
| 40 | | C |
| 50 | | C |

EXAMPLE 6

In Example 6, the additive amount of the silicone filler as the particles 87 was varied, and cleanability of each resulting photosensitive drum 50 was studied at a thrust rate of 3.52 (μm/drum rotation). The cleanability was evaluated in the same manner as in Example 4. Table 10 shows evaluation results.

TABLE 10

| Thrust amount (μm) | Thrust period (number of rotations) | Thrust rate (μm/drum rotation) |
|---|---|---|
| 250 | 71 | 3.52 |
| Filler additive amount | | Cleanability |
| 3 | | A3 |
| 10 | | A3 |
| 20 | | A3 |
| 30 | | B3 |
| 40 | | B3 |
| 50 | | C |

COMPARATIVE EXAMPLE 3

In Comparative Example 3, the additive amount of the silicone filler as the particles 87 was varied, and cleanability of each resulting photosensitive drum was studied at a thrust rate of 0.00 (μm/drum rotation), that is, under a condition of no thrusting. The cleanability was evaluated in the same manner as in Example 4. Table 11 shows evaluation results.

TABLE 11

| Thrust amount (μm) | Thrust period (number of rotations) | Thrust rate (μm/drum rotation) |
|---|---|---|
| 0 | — | 0.00 |
| Filler additive amount | | Cleanability |
| 3 | | A3 |
| 10 | | A3 |
| 20 | | A3 |
| 30 | | A3 |
| 40 | | B3 |
| 50 | | B3 |

The study results obtained in Examples 4 to 6 and Comparative Example 3 are evaluated with reference to FIGS. 10A and 10B. FIGS. 10A and 10B are diagrams showing the relationship between the thrust rate, the additive amount of the silicone filler, and the cleanability. In FIGS. 10A and 10B, the horizontal axis represents thrust rate (μm/photosensitive drum rotation), and the vertical axis represents additive amount (part by mass) of the silicone filler. A logarithmic scale is on the horizontal axis of FIG. 10B. FIGS. 10A and 10B are created based on the evaluation results shown in Tables 8 to 11.

A region A3 was a region resulting in cleanability evaluated as A3. An upper limit for the region A3, which is represented by a dashed line b1, decreased with increase in the thrust rate. As the upper limit for the region A3, the largest additive amount was 30 parts by mass, and the smallest additive amount was 3 parts by mass. A lower limit for the region A3 was 3 parts by mass.

A region B3 was a region resulting in cleanability evaluated as B3. A lower limit for the region B3, which is represented by the dashed line b1, decreased with increase in the thrust rate. As the lower limit for the region B3, the largest additive amount was 30 parts by mass, and the smallest additive amount was 3 parts by mass. An upper limit for the region B3, which is represented by a dashed line b2, decreased with increase in the thrust rate. As the upper limit for the region B3, the largest additive amount was 50 parts by mass, and the smallest additive amount was 20 parts by mass.

A region C was a region resulting in cleanability evaluated as C. A lower limit for the region C, which is represented by the dashed line b2, decreased with increase in the thrust rate. As the lower limit for the region C, the largest additive amount was 50 parts by mass, and the smallest additive amount was 20 parts by mass. An upper limit for the region C was 50 parts by mass.

It has been confirmed that evaluation A3 can be ensured with respect to a wide range of thrust rate through the additive amount of the silicone filler being adjusted to decrease with increase in the thrust rate. The same is true for evaluation B3.

EXAMPLE 7

In Example 7, a photosensitive drum 50 was used whose circumferential surface had been adjusted to have a friction coefficient of 0.35 by adding 5 parts by mass of the silicone filler as the particles 87 relative to 100 parts by mass of the binder resin in the photosensitive layer 85 based on the relationship shown in FIG. 9 to measure the surface roughness of the photosensitive drum 50 every predetermined number of printed pages. The thrust amount of the photosensitive drum 50 was 0.25 mm, and the thrust period of the photosensitive drum 50 was 200 rotations. Table 12 shows measurement results.

EXAMPLE 8

In Example 8, a photosensitive drum 50 was used whose circumferential surface had been adjusted to have a friction coefficient of 0.34 by adding 20 parts by mass of the silicone filler as the particles 87 based on the relationship shown in FIG. 9. Other than that, the surface roughness of the photosensitive drum 50 was measured in the same manner as in Example 7. Table 12 shows measurement results.

COMPARATIVE EXAMPLE 4

In Comparative Example 4, the amount of the silicone filler added as the particles 87 was 0 parts by mass. Other than that, the surface roughness of the resulting photosensitive drum was measured in the same manner as in Example 7. Table 12 shows measurement results.

COMPARATIVE EXAMPLE 5

In Comparative Example 5, the amount of the silicone filler added as the particles 87 was 0 parts by mass, and thrusting was not performed. Other than that, the surface roughness of the resulting photosensitive drum 50 was measured in the same manner as in Example 7. Table 13 shows measurement results.

COMPARATIVE EXAMPLE 6

In Comparative Example 6, the amount of the silicone filler added as the particles 87 was 5 parts by mass, and thrusting was not performed. Other than that, the surface roughness of the resulting photosensitive drum 50 was measured in the same manner as in Example 7. Table 13 shows measurement results.

TABLE 12

| | Thrusting performed Surface roughness (μm) | | |
|---|---|---|---|
| Number of printed pages (k pages) | 0 parts by mass | 5 parts by mass | 20 parts by mass |
| 0 | 0.1245 | 0.3260 | 0.4400 |
| 41 | — | — | 0.5612 |
| 44 | 0.7400 | 0.6360 | — |
| 100 | 0.8200 | 0.6288 | 0.600 |

TABLE 13

| | Thrusting not performed Surface roughness (μm) | |
|---|---|---|
| Number of printed pages (k pages) | 0 parts by mass | 5 parts by mass |
| 0 | 0.1245 | 0.326 |
| 28 | 0.811 | 0.45 |
| 66 | 1.1 | 0.63 |
| 125 | 1.73 | 1.005 |
| 200 | 1.84 | 1.25 |

Figure 11:
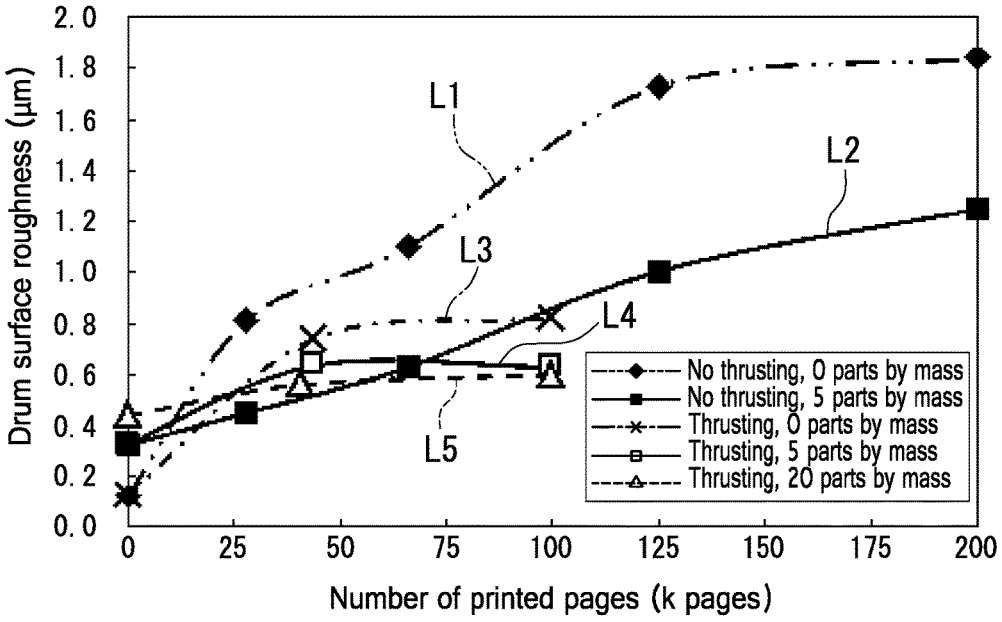
FIG. 11 is a graph showing a relationship of surface roughness of photosensitive drums to the number of printed pages with respect to each of specific filler additive amounts and whether or not thrusting is performed.

FIG. 11 is a graph showing a relationship between the number of printed pages and the surface roughness of the photosensitive drums 50, in which values shown in Tables 12 and 13 are plotted. The horizontal axis represents the number of printed pages (k pages), and the vertical axis represents surface roughness (μm) of the photosensitive drums 50. A line L1 shows data of Comparative Example 5. A line L2 shows data of Comparative Example 6. A line L3 shows data of Comparative Example 4. A line L4 shows data of Example 7. A line L5 shows data of Example 8.

As shown in Tables 12 and 13, and FIG. 11, in an initial state in which the number of printed pages was 0, the more the additive amount of the silicone filler was, the larger the surface roughness of the photosensitive drum 50 was. However, once the number of printed pages increased, the more the additive amount of the silicone filler was, the smaller the surface roughness of the photosensitive drum 50 was. It has been confirmed that inclusion of the silicone filler can allow prevention of the surface roughness of the photosensitive drum 50 from increasing as a result of printing.

It has been also confirmed that a saturation level of the surface roughness of the photosensitive drum 50 is smaller when thrusting is performed than when thrusting is not performed. It has been therefore confirmed that thrusting can allow prevention of the surface roughness of the photosensitive drum 50 from increasing as a result of printing.

<Evaluation of Surface Roughness and Image>

A relationship between the surface roughness of a photosensitive drum 50 and images that were formed was studied as described below. Using the above-described multifunction peripheral, lateral sheet conveyance of A4 size paper was performed, and image formation was performed on 100,000 successive sheets of the paper using an original document at a coverage of 5% in a standard temperature and humidity environment (23 to 26° C. and 40 to 60% RH). The additive amount of the silicone filler was 5 parts by mass. The thrust amount of the photosensitive drum 50 was 0.25 mm, and the thrust period of the photosensitive drum 50 was 500 rotations.

During the successive image formation, a halftone image was formed each time the surface roughness of the photosensitive drum 50 reached one of values shown in Table 14, and the resulting halftone images were visually observed. The observed images were evaluated in accordance with the following standard. Table 14 shows evaluation results.

G (Good): No streak observed in halftone image

NS (Not sufficient): Streak observed in halftone image

Note that a streak observed in a halftone image is thought to be resulting from a circumferential scratch on the circumferential surface of the photosensitive drum 50 that occurred as a result of image formation on 100,000 successive sheets.

TABLE 14

| Surface roughness (μm) | 1.2 | 1.3 | 1.4 | 1.5 | 1.6 | 1.7 |
|---|---|---|---|---|---|---|
| Image evaluation | G | G | G | G | NS | NS |

As shown in Table 14, the resulting halftone images were good as having no streak when the surface roughness of the photosensitive drum 50 was not greater than 1.5 μm.

As shown in Table 14, the evaluation results have proved that the image forming apparatus 1 including the photosensitive drum 50 having a suitable surface roughness can form a good halftone image having no streak. Furthermore, as shown in Tables 12 and 13, and FIG. 11, the evaluation results have proved that the image forming apparatus 1 including the specific drive mechanism 90 and the photosensitive drum 50 including the photosensitive layer 85 containing the particles 87 (for example, silicone filler) can maintain the surface roughness of the photosensitive drum 50 within a suitable range even after the number of printed pages has increased. It is thought that as a result, the image forming apparatus 1 can form good images over a long period of time.

EXAMPLE 9

In Example 9, a relationship between adhesion of toner to a photosensitive drum 50, and the hardness and the rebound resilience of the cleaning blade 81 was studied. The additive amount of the silicone filler as the particles 87 was 5 parts by mass relative to 100 parts by mass of the binder resin in the photosensitive layer 85. Printing was performed on 50,000 successive sheets (that is, 50,000-sheet continued printing was performed) in a high temperature and humidity environment (32.5° C., 80% RH). After the continued printing, dots of adhering toner included in an entire circumferential surface of the photosensitive drum 50 were counted.

Figure 12:
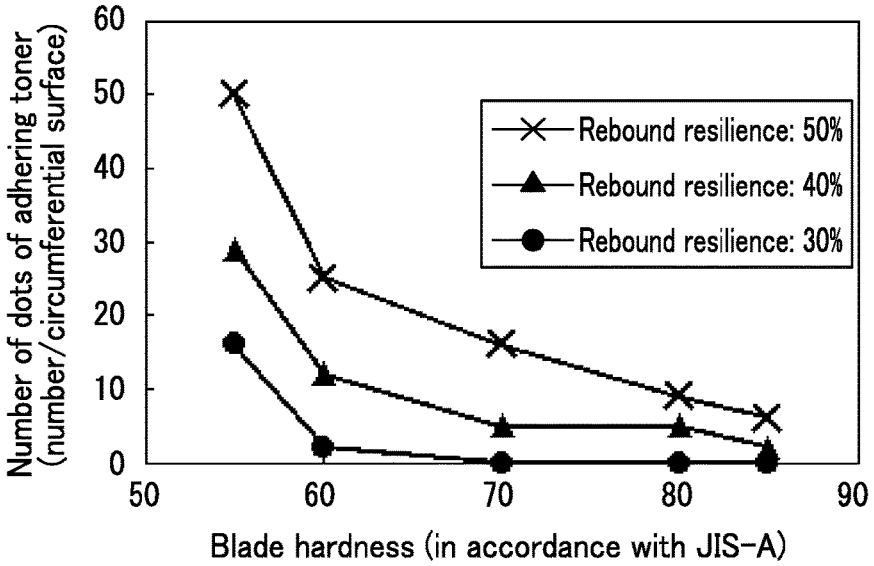
FIG. 12 is a graph showing a relationship between hardness of a cleaning blade and the number of dots of adhering toner included in an entire circumferential surface of a photosensitive drum of an image forming apparatus according to Example 9 of the present invention.

FIG. 12 is a graph showing a relationship between the hardness of the cleaning blade 81 and the number of dots of adhering toner shown in Table 15. The horizontal axis represents hardness (in accordance with JIS-A) of the cleaning blade 81, and the vertical axis represents the number of dots of adhering toner. The hardness of the cleaning blade 81 was varied for each of three values of the rebound resilience (30%, 40%, and 50%) of the cleaning blade 81 to count dots of adhering toner included in an entire circumferential surface of the photosensitive drum 50.

The second column of Table 15 shows the number of dots of adhering toner when the rebound resilience of the cleaning blade 81 was 30%. The third column of Table 15 shows the number of dots of adhering toner when the rebound resilience of the cleaning blade 81 was 40%. The fourth column of Table 15 shows the number of dots of adhering toner when the rebound resilience of the cleaning blade 81 was 50%.

TABLE 15

| Hardness | Rebound resilience 30% | Rebound resilience 40% | Rebound resilience 50% |
|---|---|---|---|
| 55 | 16 | 29 | 50 |
| 60 | 2 | 12 | 25 |
| 70 | 0 | 5 | 16 |
| 80 | 0 | 5 | 9 |
| 85 | 0 | 2 | 6 |

It has been confirmed that the higher the hardness of the cleaning blade 81 is, the less the number of dots of adhering toner is, that is, the more toner adhesion can be restricted. A higher hardness provides a stronger force for scraping the residual toner T adhering to the circumferential surface of the photosensitive drum 50. It has been also confirmed that the smaller the rebound resilience of the cleaning blade 81 is, the less the number of dots of adhering toner is, that is, the more toner adhesion can be restricted. A smaller rebound resilience provides less minute movement (stick-slip) of the edge of the cleaning blade 81, preventing the residual toner T from escaping capture by the cleaning blade 81 and thus restricting adhesion of the residual toner. It has been confirmed that the number of dots of adhering toner is 0, that is, toner adhesion does not occur when the hardness of the cleaning blade 81 is not less than 70 and the rebound resilience of the cleaning blade 81 is not greater than 30%.

Through the above, an embodiment of the present invention has been described with reference to the accompanying drawings. However, the present invention is not limited to the embodiment described above and may be implemented in various different forms so long as such implementations do not deviate from the intended scope of the present invention as described below. The drawings illustrate elements of configuration schematically in order to facilitate understanding, and properties of the elements of configuration in the drawings, such as thickness, length, and quantity, may differ from reality in order to aid preparation of the drawings. Shapes, dimensions, etc. of the elements of configuration given in the above embodiment are merely examples that do not impart any particular limitations and may be altered in various ways, so long as such alterations do not substantially deviate from the effect of the present invention.

In the present embodiment, the photosensitive drums 50 are caused to reciprocate in the rotational axis direction D, and the cleaning blades 81 are fixed to the housing of the image forming apparatus 1. However, the drive mechanism 90 may cause the cleaning blades 81 to reciprocate in the rotational axis direction D, and the photosensitive drums 50 may be fixed to the housing of the image forming apparatus 1. Adhesion of the residual toner T to the photosensitive drums 50 can be restricted by reducing the friction coefficient of the circumferential surfaces of the photosensitive drums 50 while reducing occurrence of a circumferential scratch on the photosensitive drums 50 by causing the cleaning blades 81 to reciprocate.

The thrust amount of each cleaning blade 81 refers to a distance by which the cleaning blade 81 travels in one way of one back-and-forth motion. An outward thrust amount and a return thrust amount are the same. For the same reason as for the photosensitive drums 50, each cleaning blade 81 preferably has a thrust amount of at least 0.1 mm and no greater than 1.5 mm, and more preferably at least 0.25 mm and no greater than 1.0 mm.

The thrust period of each cleaning blade 81 refers to a time taken by the cleaning blade 81 to make one back-and-forth motion. In the present description, the thrust period of the cleaning blade 81 is indicated by the number of rotations of the photosensitive drum 50 per back-and-forth motion of the cleaning blade 81. The rotation speed of the photosensitive drum 50 is constant. Accordingly, a longer thrust period means that the cleaning blade 81 reciprocates more slowly. A shorter thrust period means that the cleaning blade 81 reciprocates faster. For the same reason as for the photosensitive drums 50, each cleaning blade 81 preferably has a thrust period of at least 10 rotations and no greater than 1,000 rotations, and more preferably at least 50 rotations and no greater than 300 rotations.

INDUSTRIAL APPLICABILITY

The present invention is applicable to the field of image forming apparatuses that form images on sheets.

The invention claimed is:

1. An image forming apparatus comprising:
an image bearing member;
a cleaning member in pressed contact with a circumferential surface of the image bearing member; and
a drive mechanism configured to cause one of the image bearing member and the cleaning member to reciprocate in a rotational axis direction of the image bearing member, wherein
the image bearing member includes a photosensitive layer having an outermost layer containing a plurality of particles,
a number of rotations of the image bearing member per back-and-forth motion of the one of the image bearing member and the cleaning member is at least 10 and no greater than 1,000,
a distance by which the one of the image bearing member and the cleaning member travels in one way of one back-and-forth motion is at least 0.1 mm and no greater than 1.5 mm, and
the circumferential surface of the image bearing member has a friction coefficient of no greater than 0.5.

2. The image forming apparatus according to claim 1, wherein
a circumferential surface of the photosensitive layer constitutes the circumferential surface of the image bearing member and has a base surface,
some particles of the plurality of particles project from the base surface, the particles projecting from the base surface being present at the circumferential surface, and
the particles projecting from the base surface are uniformly distributed.

3. The image forming apparatus according to claim 2, wherein
each of the plurality of particles has a smaller friction coefficient than the base surface.

4. The image forming apparatus according to claim 2, wherein
each of the plurality of particles has a higher hardness than the base surface.

5. The image forming apparatus according to claim 1, wherein
the distance by which the one of the image bearing member and the cleaning member travels in one way of one back-and-forth motion is at least 0.25 mm and no greater than 1.0 mm.

6. The image forming apparatus according to claim 1, wherein
the image bearing member has a surface roughness of greater than 0 μm and no greater than 2.0 μm,
the cleaning member has a hardness of at least 65, and
the cleaning member has a rebound resilience of greater than 0% and no greater than 35%.

7. The image forming apparatus according to claim 6, wherein
the image bearing member has a surface roughness of at least 0.2 μm and no greater than 1.5 μm.

8. The image forming apparatus according to claim 1, wherein
the plurality of particles are a silicone filler,
the photosensitive layer further contains a binder resin, and
the plurality of particles are contained in an amount of at least 3 parts by mass and no greater than 40 parts by mass relative to 100 parts by mass of the binder resin in the photosensitive layer.

9. The image forming apparatus according to claim 8, wherein
the plurality of particles are contained in an amount of at least 5 parts by mass and no greater than 30 parts by mass relative to 100 parts by mass of the binder resin in the photosensitive layer.

10. The image forming apparatus according to claim 1, further comprising
a charger, wherein
the charger adopts contact charging, and
the charger applies a direct current voltage to the circumferential surface of the image bearing member.

11. The image forming apparatus according to claim 1, wherein
a toner is supplied to the circumferential surface of the image bearing member,
the toner includes a plurality of toner particles,
each of the plurality of toner particles has a toner mother particle and an external additive adhering to a surface of the toner mother particle, and
the external additive includes an abrasive.

12. The image forming apparatus according to claim 11, wherein
the toner that is supplied to the image bearing member has a minimum fixing temperature of no greater than 160° C.

13. An image forming method for forming an image on a sheet using a toner, comprising:

removing the toner remaining on a circumferential surface of an image bearing member by causing one of the image bearing member and a cleaning member in pressed contact with the circumferential surface of the image bearing member to reciprocate in a rotational axis direction of the image bearing member while causing the image bearing member to rotate, wherein the image bearing member includes a photosensitive layer having an outermost layer containing a plurality of particles, a number of rotations of the image bearing member per back-and-forth motion of the one of the image bearing member and the cleaning member is at least 10 and no greater than 1,000, a distance by which the one of the image bearing member and the cleaning member travels in one way of one back-and-forth motion is at least 0.1 mm and no greater than 1.5 mm, the circumferential surface of the image bearing member has a friction coefficient of no greater than 0.5, the toner includes a plurality of toner particles, each of the plurality of toner particles has a toner mother particle and an external additive adhering to a surface of the toner mother particle, and the external additive includes an abrasive.

14. The image forming method according to claim 13, wherein the image bearing member has a surface roughness of at least 0.2 μm and no greater than 1.5 μm.

* * * * *